US008256249B2

(12) United States Patent
Lim et al.

(10) Patent No.: US 8,256,249 B2
(45) Date of Patent: Sep. 4, 2012

(54) LAUNDRY MACHINE

(75) Inventors: Jae Yoen Lim, Gyeongsangnam-do (KR); Jong Chul Bang, Gyeongsangnam-do (KR); Ki Chul Cho, Gyeongsangnam-do (KR); Seong No Yoon, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 472 days.

(21) Appl. No.: 12/432,242

(22) Filed: Apr. 29, 2009

(65) Prior Publication Data

US 2010/0077803 A1 Apr. 1, 2010

(30) Foreign Application Priority Data

Apr. 30, 2008 (KR) ..... 10-2008-0040945
Apr. 30, 2008 (KR) ..... 10-2008-0040946
Apr. 30, 2008 (KR) ..... 10-2008-0040947
Apr. 30, 2008 (KR) ..... 10-2008-0040948

(51) Int. Cl.
*D06F 37/00* (2006.01)

(52) U.S. Cl. ..... 68/212; 68/3 R; 68/139; 15/3; 134/58 R

(58) Field of Classification Search ..... None
See application file for complete search history.

(56) References Cited

U.S. PATENT DOCUMENTS 2,030,630 A 5/1935 Gram
5,012,794 A 5/1991 Faurel
5,181,857 A * 1/1993 Layser ..... 439/157
5,267,456 A 12/1993 Nukaga et al.
5,490,697 A 2/1996 Surko, Jr.
5,823,017 A 10/1998 Hapke et al.
6,145,898 A 11/2000 Onderka et al.
6,603,377 B2 8/2003 Cho et al.

(Continued)

FOREIGN PATENT DOCUMENTS

CN 2298273 Y 11/1998

(Continued)

OTHER PUBLICATIONS

EPO machine translation for EP 0481503, retrieved on Nov. 19, 2011 from http://translationportal.epo.org/emtp/translate/?ACTION=description-retrieval&COUNTRY=EP&FORMAT=docdb&KIND=A1&LOCALE=en_EP&NUMBER=0481503&OPS=ops.epo.org&TRGLANG=en&ENGINE=google&SRCLANG=de and http://translationportal.epo.org/emtp/translate/?ACTION=claims-retrieval&COUNTRY=EP&FORMAT=docdb&KIND=A1&LOCALE=en_EP&NUMBER=0481503&OPS=ops.epo.org&TRGLANG=en&ENGINE=google&SRCLANG=de.*

(Continued)

*Primary Examiner* — Michael Kornakov
*Assistant Examiner* — Eric Golightly
(74) *Attorney, Agent, or Firm* — Birch, Stewart, Kolasch & Birch, LLP

(57) ABSTRACT

The present invention relates to laundry machines, and, more particularly, to a safe laundry machine which enables a user to open/close a door easily, and can prevent an accident caused by opening/closing of the door from taking place.
The laundry machine includes a cabinet, a drum rotatably mounted in the cabinet, a door having a latch for being opened/closed selectively to expose an inside of the drum to an outside of the laundry machine, and a door switch assembly provided for enabling opening/closing of the door, wherein the door switch assembly includes a switch unit for making selective connection to the latch, and an opening operation unit spaced from the switch unit for the user to enable to disconnect the connection between the latch and the switch unit.

12 Claims, 13 Drawing Sheets

U.S. PATENT DOCUMENTS

| | | | | |
|---|---|---|---|---|
| 7,306,266 | B2 | 12/2007 | Hapke et al. | |
| 7,585,006 | B2 | 9/2009 | Alacqua et al. | |
| 2005/0151620 | A1 | 7/2005 | Neumann | |
| 2005/0194795 | A1* | 9/2005 | Hapke et al. | 292/216 |
| 2006/0012190 | A1* | 1/2006 | Alacqua et al. | 292/341.16 |
| 2008/0100066 | A1 | 5/2008 | Mueller et al. | |
| 2010/0083712 | A1* | 4/2010 | Lim et al. | 68/139 |

FOREIGN PATENT DOCUMENTS

| | | | |
|---|---|---|---|
| EP | 0 481 503 | A1 | 4/1992 |
| EP | 1 001 069 | A1 | 5/2000 |
| EP | 1 245 762 | A1 | 10/2002 |
| GB | 1 350 911 | | 4/1974 |
| JP | 6-063288 | A | 3/1994 |
| JP | 2007-111108 | A | 5/2007 |
| KR | 10-2006-0089442 | A | 8/2006 |
| KR | 10-0653913 | B1 | 11/2006 |
| WO | WO 2004/113653 | A1 | 12/2004 |
| WO | WO 2007/137861 | A1 | 12/2007 |

OTHER PUBLICATIONS

JPO machine translation of Kono (JP 2007111108), retrieved from http://www19.ipdl.inpit.go.jp/PA1/cgi-bin/PA1DETAIL and http://www4.ipdl.inpit.go.jp/Tokujitu/PAJdetail.ipdl?N0000=60&N0120=01&N2001=2&N3001=2007-111108 on Mar. 9, 2012.*

* cited by examiner

LAUNDRY MACHINE

CROSS REFERENCE TO RELATED APPLICATION

This application claims the benefit of the Patent Korean Application Nos. 10-2008-0040945, filed on Apr. 30, 2008, 10-2008-0040946, filed on Apr. 30, 2008, 10-2008-0040947, filed on Apr. 30, 2008 and 10-2008-0040948, filed on Apr. 30, 2008 which are hereby incorporated by reference as if fully set forth herein.

BACKGROUND OF THE DISCLOSURE

1. Field of the Disclosure

The present invention relates to laundry machines, and, more particularly, to a safe laundry machine which enables a user to open/close a door easily, and can prevent accident caused by opening/closing of the door from taking place.

2. Discussion of the Related Art

In general, the laundry machine is an apparatus for washing, drying, refreshing and so on the laundry. The laundry machine has a space for holding the laundry for introducing the laundry thereto, and performing operation (will be called as washing operation for convenience's sake) for making washing, drying or refreshing the laundry by using various components mounted therein.

In general, the laundry machine has a drum provided therein for holding the laundry for making the washing operation.

The user opens the door and introduces the laundry to the drum, and if the washing operation is finished, the user opens the door and takes out the laundry. The drum is designed to rotate in the washing operation, and the laundry and the washing water flows in the drum following the rotation of the drum. Alikely, the drum may have a high temperature environment formed therein for drying or the like. Due to these reasons, a door is required for user's easy opening/closing of the door, and making an inside of the drum into an enclosed space that is isolated from an outside of the laundry machine during washing, taking safety of the user into account.

The laundry machine has a door switch mounted thereto for maintaining a locking state in which the door does not open during the washing operation. The door switch maintains the locking state by power applied thereto during the washing operation, and, if the washing operation is finished, the door switch releases the locking state by power cut off if the washing operation is finished. Accordingly, in general, a related art door switch is designed to be controlled electrically depending on the washing operation.

The door switch controlled electrically thus has a problem in that many small faults take place due to frequent opening/closing and impacts of the door. In the meantime, a certain portion of the door switch can not, but be exposed to an outside of the laundry machine for opening/closing of the door, providing an environment in which electric circuits and the like are susceptible to exposure to an outside of the laundry machine, which results in malfunction and short lifetime of the door switch.

The fault of the electric door switch causes a problem in which the laundry can not be taken out of the drum as the door is unable to open, and endangers a life as a child can not open the door from an inside of the drum. Of course, there is also a problem in that, since the door is closed still even if the locking state is released, power is required for opening the door by overcoming a mechanism between the door switch and the door.

In the meantime, in the related art laundry machine, there is a type in which the door switch is provided to a door handle. In the laundry machine, the user can open the door by pressing the door switch in a state the user holds the door handle. Since the door is on a front of the laundry machine, and the door handle is provided to a side of the door, the user is required to apply power to the door in a sit down or crouching position for opening the door.

Accordingly, opening/closing of the door is not easy, and since it is required to press the door switch from an outside of the drum, making a child unable to open the door from an inside of the drum, a child's life can be endangered.

SUMMARY OF THE DISCLOSURE

Accordingly, the present invention is directed to a laundry machine.

In more detail, an object of the present invention is to provide a laundry machine which enables a user to make easy opening/closing of a door to provide a laundry machine easy to use.

Another object of the present invention is to provide a laundry machine which has a mechanical door switch provided thereto for enhancing a lifetime and safety of the laundry machine.

Another object of the present invention is to provide a laundry machine which enables easy opening of the door even from an inside of a drum for preventing child accident caused by negligence.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet, a drum rotatably mounted in the cabinet, a door having a latch for being opened/closed selectively to expose an inside of the drum to an outside of the laundry machine, and a door switch assembly provided for enabling opening/closing of the door.

The door switch assembly may include a switch unit for making selective connection to the latch, and an opening operation unit spaced from the switch unit for the user to enable to disconnect the connection between the latch and the switch unit. The opening operation unit may be provided to the control panel.

The switch unit may be provided to open the door through operation of the opening operation unit by the user. When the user operates the opening operation unit the door can be opened by the elastic returning force.

The door switch assembly may include a cable provided between the opening operation unit and the switch unit to transmit the kinematical position change.

The door switch assembly may include a locking unit for limiting mechanical movement of the switch unit to maintain a door locking state. The locking unit may include a locking release unit for making forcible release of the door locking state.

The door switch assembly may include an opening/closing detecting unit for detecting or sensing opening and closing of the door. The opening/closing detecting unit may be devised such that the opening/closing detecting unit is moved by the latch when the door is closing, and is returning when the door is opening.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
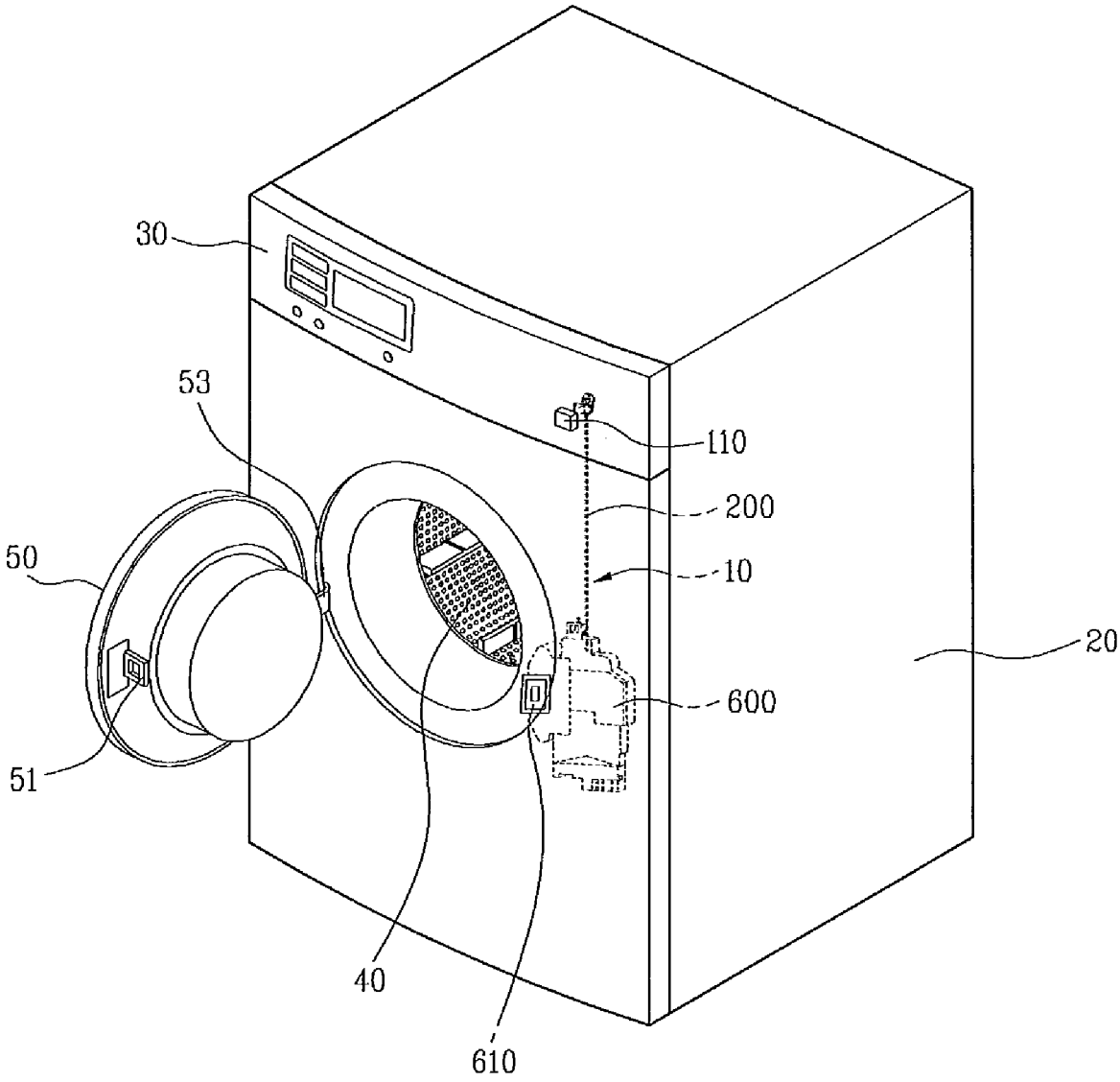
FIG. 1 illustrates a perspective view of a laundry machine having a door switch assembly in accordance with a preferred embodiment of the present invention applied thereto.

FIG. 1 illustrates a perspective view of a laundry machine having a door switch assembly in accordance with a preferred embodiment of the present invention applied thereto.

Referring to FIG. 1, the laundry machine may include a cabinet 20 which forms an exterior of the laundry machine, and a control panel 30 for enabling a user to operation and the like of the laundry machine. Taking convenience of operation into account, it is preferable that the control panel 30 is positioned on an upper side of the cabinet 20 for easy operation of the control panel 30. That is, as shown in FIG. 1, the control panel 30 can be provided to the upper side of the front of the cabinet 20, or a top or an edge between the top and the front of the cabinet 20. The control panel 30 may have a controller (not shown) provided thereto for controlling the laundry machine.

The cabinet 20 may have a drum 40 provided therein for holding the laundry. The drum 40 is provided to be rotatable in the washing operation.

A door 50 may be provided in front of the drum 40 for introducing/taking out the laundry to/from the drum. In general, the door 50 is mounted to one side of the cabinet 20 to enable opening/closing, and preferably has one side rotatably secured to a hinge 53 or the like. In this instance, it is preferable that a side of the door 50 opposite to a portion secured to the hinge 53 or the like is fastened/unfastened to/from the cabinet 20 in opening/closing of the door 50.

Referring to FIG. 1, at a rear wall of the door 50, there can be a latch 51 projected to a rear side, i.e., in an inside direction of the cabinet 20. As the door 50 rotates round the portion secured to the hinge 53 or the like, with the latch 51 selectively engaged with the cabinet 20, the opening/closing of the door 50 can be made.

In the meantime, it is preferable that the cabinet 20 has a door switch assembly 10 for enabling opening/closing the door 50 together with the latch 51. That is, in a case the door 50 is closed, the door switch assembly 10 is connected to the latch 51 to fasten the door 50, and if it is intended to open the door 50, the door switch assembly 10 is disconnected from the latch 51 to let the door 50 rotate to open.

The door switch assembly 10 has an inserting hole 610 for inserting the latch therein. The door switch assembly 10 is mounted such that the inserting hole is exposed to the front of the cabinet 20, and other components of the door switch assembly 10 is on an inside of the cabinet 20. For an example, if the inserting hole 610 is formed in the case 600 of the door switch assembly 10, it is preferable that only an inserting hole 610 portion is exposed to an outside of the cabinet 20 through the front of the cabinet 20, while the other portions are within the cabinet 20. This is for taking beauty of the laundry machine into account as well as for protecting the door switch assembly 10 from external environment.

As a component of the door switch assembly 10, a button 110 may be provided to the cabinet 20 for the user to apply a force to release a locking state of the door. Preferably, the button 110 is provided to an upper side of the cabinet 20, and more preferably on one side of the control panel 30 where most of operation of the user is made.

Accordingly, the user can make easy release of the locking state of the door by pressing the button 110 on the control panel 30 even with a low force without sitting or crouching. Along with this, it is possible to devise such that not only the release of the locking state of the door, but also opening of the door, can be made by using the user's force of pressing the button 110. Therefore, since the user is possible to open the door fully by applying a force required only for rotating the door opened already further, a user's effort can be minimized, which will be described later in detail.

In the meantime, referring to FIG. 1, the button 110 may be provided spaced from a case 600. On an inside of the case 600, there is a mechanism for opening/closing the door by restricting the latch 51. Therefore, means for transmission of the force applied to the button 110 to the mechanism in the case is required. As such transmission means, a cable 200 is shown in FIG. 1. The cable 200 serves to transmit the force between the button 110 and the mechanism in the case 600 spaced from each other.

Figure 2:
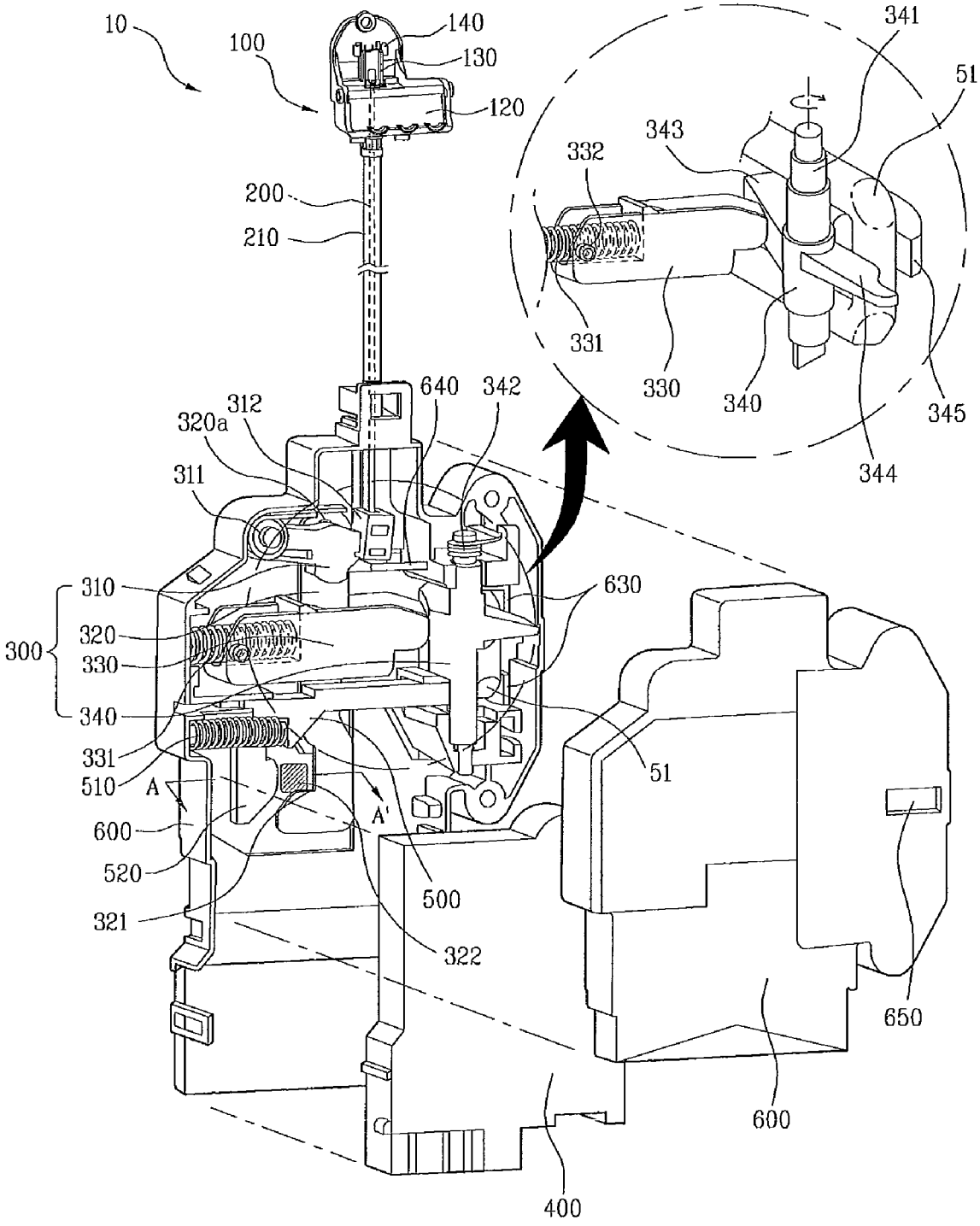
FIG. 2 illustrates a perspective view of the door switch assembly in a state the door in FIG. 1 is closed, with a case of the door switch assembly opened.

The door switch assembly 10 will be described in detail with reference to FIG. 2. FIG. 2 illustrates a perspective view of the door switch assembly 10 in a state the door in FIG. 1 is closed, with the cases of the door switch assembly opened.

The door switch assembly 10 may includes an opening operation unit 100 for releasing the locking state of the door by operation of the user. The opening operation unit 100 can serve, not only to release the locking state of the door, but also opening the door, partially. The user's operation may imply manual application of a force. In more detail, the user's operation may imply application of the force to cause position changes of some of components of the opening operation unit 100.

The door switch assembly 10 may include a switch unit 300 which is interlocked with operation of the opening operation unit 100 mechanically in opening the door 50.

The mechanical interlock implies that components of the opening operation unit 100 and the switch unit 300 are connected to one another to enable to make interlocked movements. That is, the mechanical interlock implies that the force applied through the opening operation unit 100 is transmitted to the switch unit 300 mechanically, and the switch unit 300 can open the door 50 mechanically by using the force transmitted thereto thus. Therefore, no force such as an electromagnetic force is required for opening the door partially except the user's force for operating the opening operation unit 100.

Therefore, since the door 50 can be opened/closed by using a mechanism system, enabling to simplify a system compared to the opening/closing of the door 50 by using the electromagnetic force in the related art, a lifetime of the door switch assembly can be improved.

The opening operation unit 100 will be described in detail.

The opening operation unit 100 is a unit operated by the user in a case the user intends to open the door 50. At the opening operation unit 100, the force applied by the user is transmitted to the switch unit 300. As described before, it is preferable that the opening operation unit 100 is provided to the control panel 30.

It may be defined that the force generated by the operation of the user is transmitted to the switch unit 300 as the force changes positions of detail components.

The opening operation unit 100 may include the button 110 (See FIGS. 1 and 5) provided to an outside of the control panel 50 for enabling the user to applying the force from an outside of the control panel 50, personally. The opening operation unit 100 may also include a slider 130 for securing one end of the cable 200, and a lever for changing a direction of a pressing force of the button 110 to transmit the force to the slider 130.

The opening operation unit 100 will be described in detail with reference to FIGS. 5 to 7.

The opening operation unit 100 receives the operation of the user. Therefore, such that the switch unit 300 can move interlocked with the force generated by the operation of the user, the opening operation unit 100 induces the position change of the cable 20 by using the force, to move the switch unit interlocked therewith.

In this instance, it is preferable that the opening operation unit 100 includes the button 110 for the user to apply the force thereto from an outside of the door switch assembly 10, a lever 120 for performing rotation following movement of the button 110, and the slider 130 for moving up/down following the rotation of the lever. That is, basically, at the opening operation unit 100, a rotational position change (position change of the lever 120) takes place by the force the user applies, and a linear position change (position change of the slider 130) takes place by the rotational position change. Of course, the rotational position change can take place by an initial linear position change (a position change of the button 110).

Figure 5:
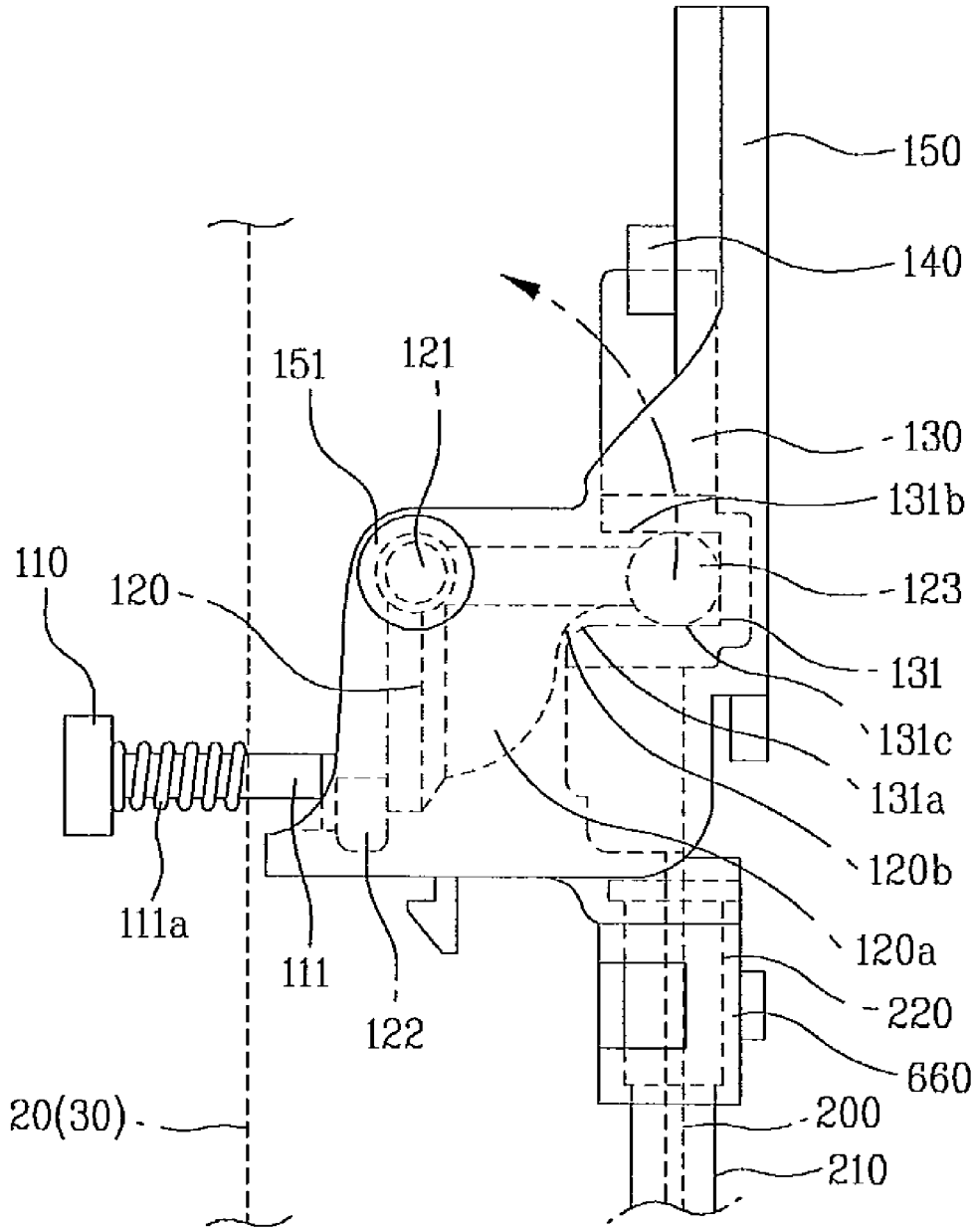
FIG. 5 illustrates a side view of the opening operation unit in FIG. 2.

Referring to FIG. 5, it is preferable that one side of the button 110 is exposed to the front of the cabinet 20 so that the user can apply the force from an outside of the cabinet 20 when the user intends to open the door 50, personally.

A leg 111 may be provided in rear of the button 110 for enabling the user to transmit the force applied by the user to the lever 120 provided in rear of the button 110. In rear of the button 110, an elastic member 111*a* may be provided for making elastic deformation following the application of the force by the user. Accordingly, it is preferable that, if the application of the force by the user is removed, the button 110 is devised to return to an original position by a restoring force of the elastic member.

In the meantime, the lever 120 may be mounted rotatable round a lever shaft 121 in a hole 151 in the opening operation unit case 150. It is preferable that the lever shaft 121 is positioned over and perpendicular to the leg 111. It is preferable that the lever 120 has a ] shape, and the lever shaft 121 is provided at an edge portion of the lever 120. According to this, if the leg 111 of the button 110 presses one end of the lever 120 in a horizontal direction, the lever 120 rotates round the lever shaft 121. In this instance, as shown in FIG. 5, the other end of the lever 121 moves upward, forming a curve.

Therefore, the button is designed to make linear motion, and the linear motion of the button is converted into rotational movement by the lever. In this point of view, the button 110 in FIG. 5 may be replaced with a pulling type instead of the pressing type. In this case, the same with above, if the lever 120 in FIG. 5 is inverted, the lever is rotated, such that the other end of the lever moves upward, forming a curve.

In rear of the lever 120, there is a slider 130 connected to the lever 120 for making movement following rotation of the lever 120. In this instance, the slider 130 can move along a vertical path within a guide 140 provided on an inside wall of the case 150.

Referring to FIG. 5, the lever 120 has an inserting portion 123 in a rear for placing in the slider 130, and the slider 130 has an inserting slot 131 for receiving the inserting portion 123 therein.

In this instance, for minimizing interference when the slider 130 moves up/down by the rotation of the lever 120, the inserting portion may be curved, and preferably may have a circular cross section.

It is preferable that the inserting slot 131 has a lower side opening 131*a* rounded for easy insertion of the inserting portion 123 in the inserting slot 131. However, it is preferable that an upper surface 131*b* and a lower surface 131*c* of the inserting slot 131 is flat for minimizing interference or friction with the inserting portion 123. Because the inserting portion 123 moves, not vertically, but upward drawing a curve. That is, because the inserting portion 123 is provided to slide forward in the inserting slot 131 as the lever 120 rotates, it is necessary to minimize interference or friction between the two.

In this instance, it is necessary to prevent the lever 120 and the slider 130 from separating from each other and to convert a vertical moving component of the rotation of the lever 120 into a vertical moving component of the slider 130 to the maximum.

For this, it is preferable that the lever 120 has a reinforcing rib 120*a* formed on an inside of the lever 120, and the rib 120*a* has a curved portion 120*b* in conformity with the lower side opening 131*a* at the inserting slot 131. It is preferable that a radius of curvature of the curved portion 120*b* is greater than a radius of curvature of the opening 131*a*.

The curved portion 120*b* has a gap to the opening 131*a* in a state the lever 120 does not rotate. However, following the rotation of the lever 120, since the slider moves upward, the curved portion 120*b* and the opening 131*a* are brought into linear contact theoretically owing to a difference of radius. Therefore, when the two are in linear contact, the friction is minimized and the forward movement of the slider is limited, thereby preventing the two from separating from each other. That is, by preventing the two from separating from each other, the maximum upward movement of the slider is made by the rotation of the lever.

Figure 6:
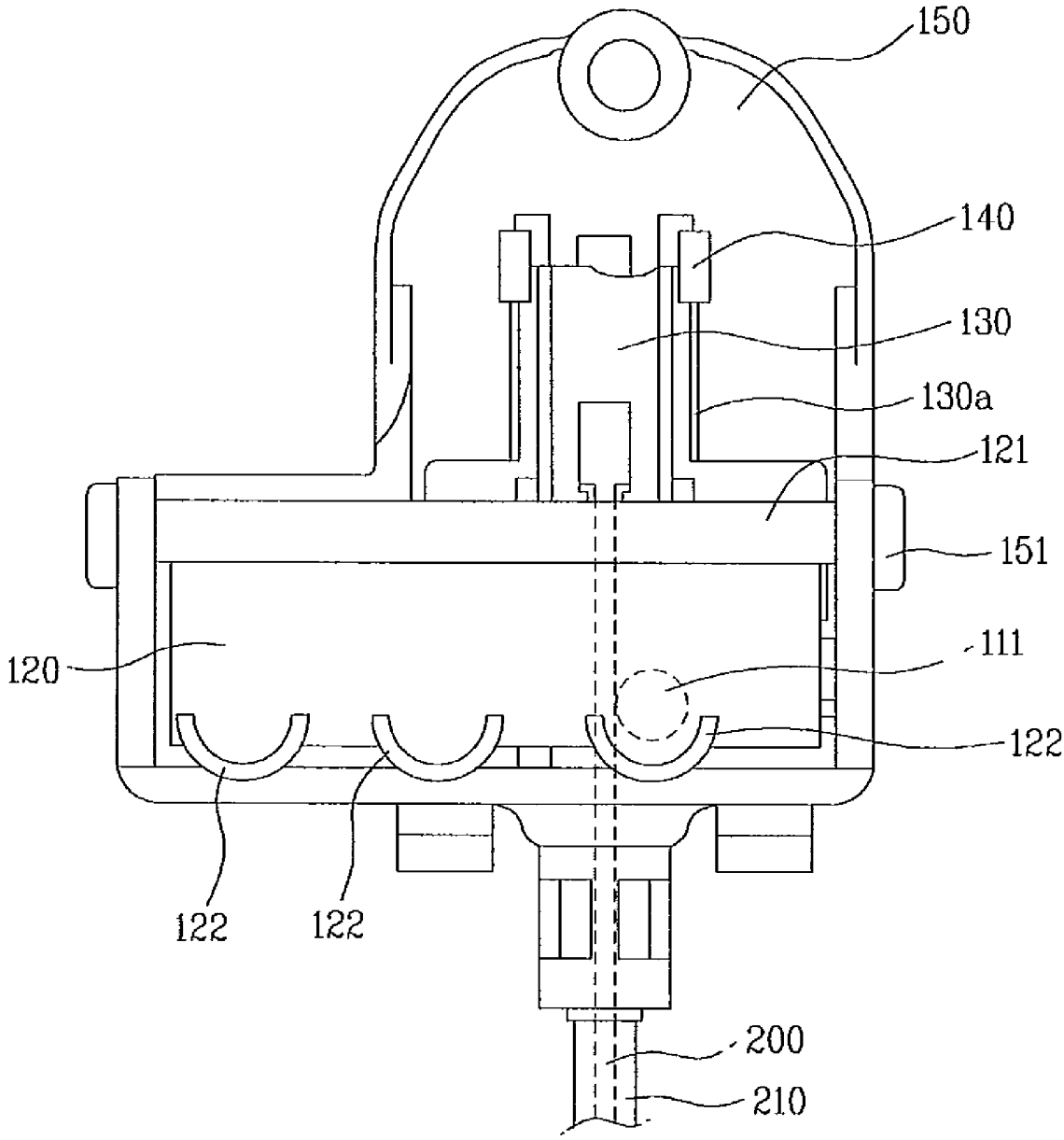
FIG. 6 illustrates a front view of the opening operation unit.
Figure 7:
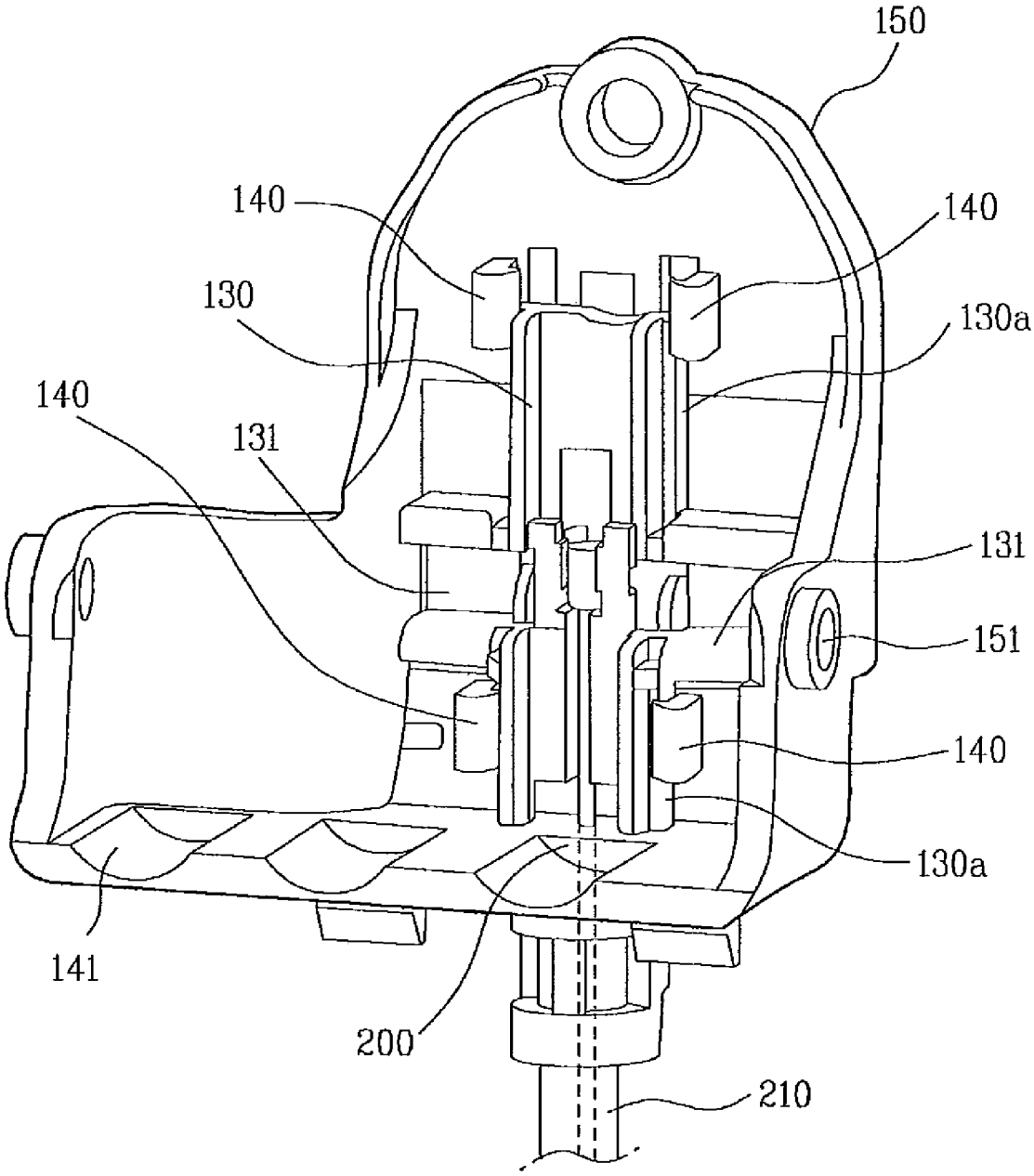
FIG. 7 illustrates a perspective view of the opening operation unit.

Referring to FIGS. 6 and 7, the case 150 may have a guide 140. The guide 140 guides the slide 130 to move up/down. Therefore, it is preferable that the guide 140 is provided to opposite sides of the slider 130.

The slider 130 may have a guide rib 130*a* in conformity with the guide 140. The guide 140 has a hook shape, and the guide rib 130*a* is in the hook of the guide 140, to limit left/right direction movement of the slider 130.

The guide 140 is provided for fastening the slider 130 in the case 150. Therefore, for making securer fastening, the guide 140 may be provided to fasten four places, i.e., upper/lower and left/right sides of the slider.

Moreover, the guide 140 limits up/down movement of the slider 130 to be made within a predetermined range. That is, the upward movement of the slider 130 is limited up to a time the guide 140 formed on an upper side is brought into contact with an upper side wall of the inserting slot 131, and the downward movement of the slider 130 is limited up to a time the guide 140 formed on a lower side is brought into contact with a lower side wall of the inserting slot 131.

In the meantime, referring to FIG. 5, the leg 111 is provided to a rear wall of the button 110 for pressing and rotating the lever 120. The leg 111 may have a cam lever shape. It is preferable that the leg 111 is provided at a position which enables to press a lower side of a front of the lever 120. Because the farther from the lever shaft 121, the less the force required for pressing.

Referring to FIGS. 5 and 6, if the leg 111 is pressed, the lever 120 rotates to move a lower end the lever 120 upward. Therefore, it is liable that movement of the lever is limited by the lower end of the lever 120 in a state the lower end of the lever is rotated. In order to prevent this from taking place, a receiver 122 is formed at the lower end of the lever 120 for receiving the leg 111. It is preferable that the receiver 122 is formed to be projected toward the leg 111, with a semi-circular shape. Along with this, it is preferable that a radius of an inside of the receiver 122 is greater than a radius of the leg 111. Accordingly, even in a case the leg moves, not horizontally, but at an angle to a horizontal direction, it can be made that the leg does not move away from a fixed range the receiver forms. Alikely, since the leg 111 is brought into contact with the receiver 122 as the lever 120 rotates, a variation of moving direction of the leg can be corrected.

If the leg 111 presses, not a right center of the lower portion of the lever, but a portion away from the right center in left or right direction, it is liable that the lever is rotated while distorting. This will be more distinctive if the leg having a large cross section is pressed with the leg 111 having a small cross section. Therefore, in order to prevent this from taking place, the case 150 may have a lever guide 141 for a lower portion of the lever to move without left/right direction distortion.

Referring to FIG. 7, the lever guide 141 may be a groove, preferably in a shape in conformity with a shape of the receiver 122. Accordingly, since a lower portion of the receiver moves within the lever guide 141, the left/right direction distortion of the lever can be prevented. In order to distribute a force intending to distort the lever in the left/right direction, it is preferable that a plurality of the receivers 122 and the lever guides 141 matching thereto are provided. FIG. 7 illustrates an example in which three of them are provided.

The switch unit 300 will be described with reference to FIG. 2.

The switch unit 300 is spaced from the opening operation unit 100 described before. Most door switch assembly 10 is in the case 600, and the case 600 is spaced from the opening operation unit 100.

The case 600, being a body of the door switch assembly 10, houses various components including the switch unit 300 for protection from an external environment.

Since the switch unit 300 serves to open/close the door in connection with the latch 51, the switch unit 300 is mounted adjacent to the inserting hole 610 (See FIG. 1). That is, it is preferable that the switch unit 300 is mounted in the case 600 adjacent to the inserting hole 610.

The switch unit 300 receives the force from the user applied through the opening operation unit 100 or a position change caused by the force. As described before, since the opening operation unit 100 and the switch unit 300 is spaced a distance, a transmission member is provided for transmission of the force or the position change between the two. FIG. 2 illustrates the cable 200 as an example.

The switch unit 300 may include a cable lever 310 for receiving a linear direction position change through the cable 200.

In detail, the cable lever 310 connected to the cable 200 receives the force the user applies to the opening operation unit through the cable 200. In this instance, the cable lever 310 may be devised to turn the force received through the cable 200 into a rotational position change. By rotatably securing one end and connecting the other end to the cable 200, the cable lever 310 may be rotated following vertical movement of the cable 200.

In this instance, by securing the one end of the cable lever 310 to a torsion spring 311, the cable lever 310 can rotate upward if the user presses the opening operation unit 100 to make an upward position change of the cable 200. However, after the user releases the pressing onto the opening operation unit 100, the cable 200 can return to an initial position by a restoring force of the torsion spring 311.

In this instance, the cable 200 moves up vertically, and in correspondence to which the other end of the cable lever 310 moves up while cable lever 310 rotates. Therefore, if the cable 200 moves up, to generate a load on the cable lever 310 in a radial direction thereof, it is liable that the cable 200 is separated from the cable lever 310. If the cable 200 is connected to the cable lever 310 loosely, it is liable that the user's operation of the opening operation unit 100 is not transmitted to the cable lever 310, directly. Alikely, in a case the cable moves up before the user's operation of the opening operation unit 100, the user's operation is meaningless.

Therefore, a structure is required for maintaining positive fastening between the cable 200 and the cable lever 410, and a length of the cable between the opening operation unit 100 and the switch unit 300 is within a proper range.

A connection structure between the opening operation unit 100 and the switch unit 300 will be described in detail, with reference to FIGS. 8 and 9.

As described before, the other end of the cable lever 310 may be a cable receiver 312 which receives an end of the cable 200. A connecting member 230 is provided at the end of the cable 200 having a cross section larger than other portion of the cable. Therefore, as the connecting member 230 having a cross section larger than other portion of the cable is inserted in the cable receiver 312, fastening between the two becomes more positive.

It is preferable that the connecting member 230 has a curved side portion for minimizing friction within the cable receiver 312. Along with this, it is preferable that a length of the connecting member is greater than a width thereof. The connecting member 230 of a circular column shape is shown.

Figure 8:
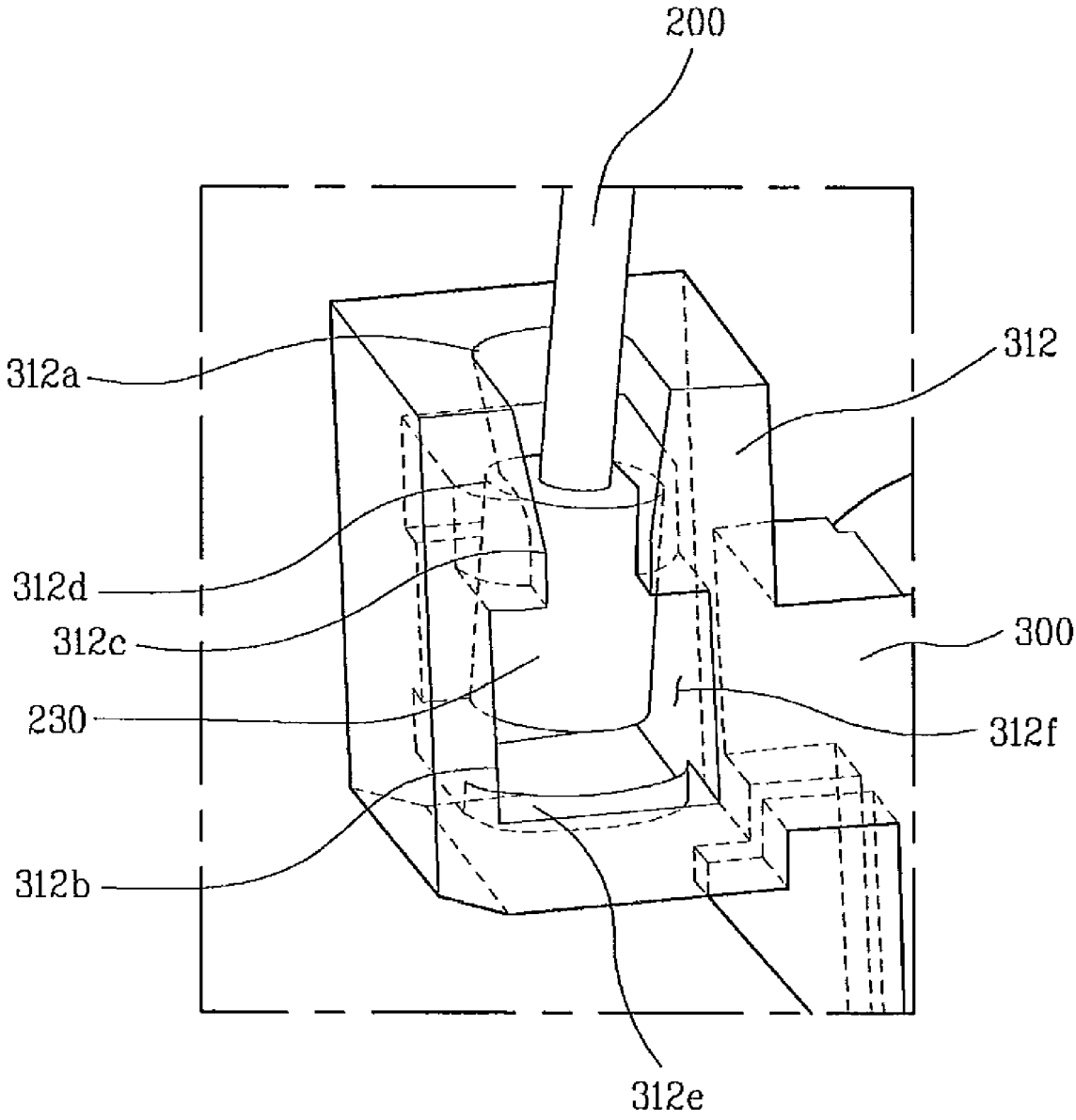
FIG. 8 illustrates a perspective view of an appearance of a portion where one end of the cable in FIG. 2 is fastened.

Referring to FIG. 8, the cable receiver 312 has an opened front, and opened top. The connecting member 230 and the cable 200 can be placed in the receiver 312 through the front thereof and the cable can be extended upward through the opened top.

In more detail, in the front of the cable receiver 312, a lower opening 312*b* and an upper side opening 312*c* are formed in shapes different from each other. The lower opening 312*b* may be formed to have a rectangular shape in conformity with a longitudinal section of the connecting member for placing the connecting member 230 therein. In this instance, it is preferable that the lower opening 312*b* has a width greater than a width of the connecting member. However, it is preferable that the lower opening 312*b* has a height lower than a height of the connecting member. This is for placing the connecting member 230 through the lower opening 312*b*, with the connecting member 230 tilted. Along with this, the lower opening 312*b* has a step portion 312*e* at an initial entrance thereof to make an inside space 312*f* of the cable receiver 312 greater. Accordingly, as shown in FIG. 8, the connecting member placed therein with the connecting member tilted can be upright in the receiver 312. This structure enables at least gravity of the cable lever to pull down the cable, the connecting member 230 can always be upright on an upper side of the inside space 312*f*. According to this, the connecting member 230 does not escape through the lower opening 312*b*. Even if the connecting member 230 is positioned on a lower side of the inside space 312*f*, the connecting member 230 does not escape through the lower opening 312*b*, because it is difficult to tilt the connecting member 230 in view of a position of the cable.

In the meantime, it is preferable that the upper side opening 312*c* in the front of the cable receiver has a structure in which the upper side opening 312*c* becomes the greater as the opening goes upward the more, and the top side opening 312*a* in the top side of the cable receiver has a structure in which the top side opening 312*a* becomes the smaller as the opening goes downward the more. That is, it is preferable that the top side opening 312*a* has a structure similar to a funnel, for preventing the cable 200 from being brought into contact with the cable receiver 312, resulting in damage of the cable. Along with this, it is preferable that a seating portion 312*d* is formed on an upper side of the inside space 312*f* for placing and securing an upper side of the connecting member 230 thereto. This is for seating the connecting member 230 on the seating portion 312*c* as the cable 200 extends upward, preventing the connecting member 230 from moving, so that the position change is transmitted from the cable to the switch unit 300 to the maximum.

Figure 9:
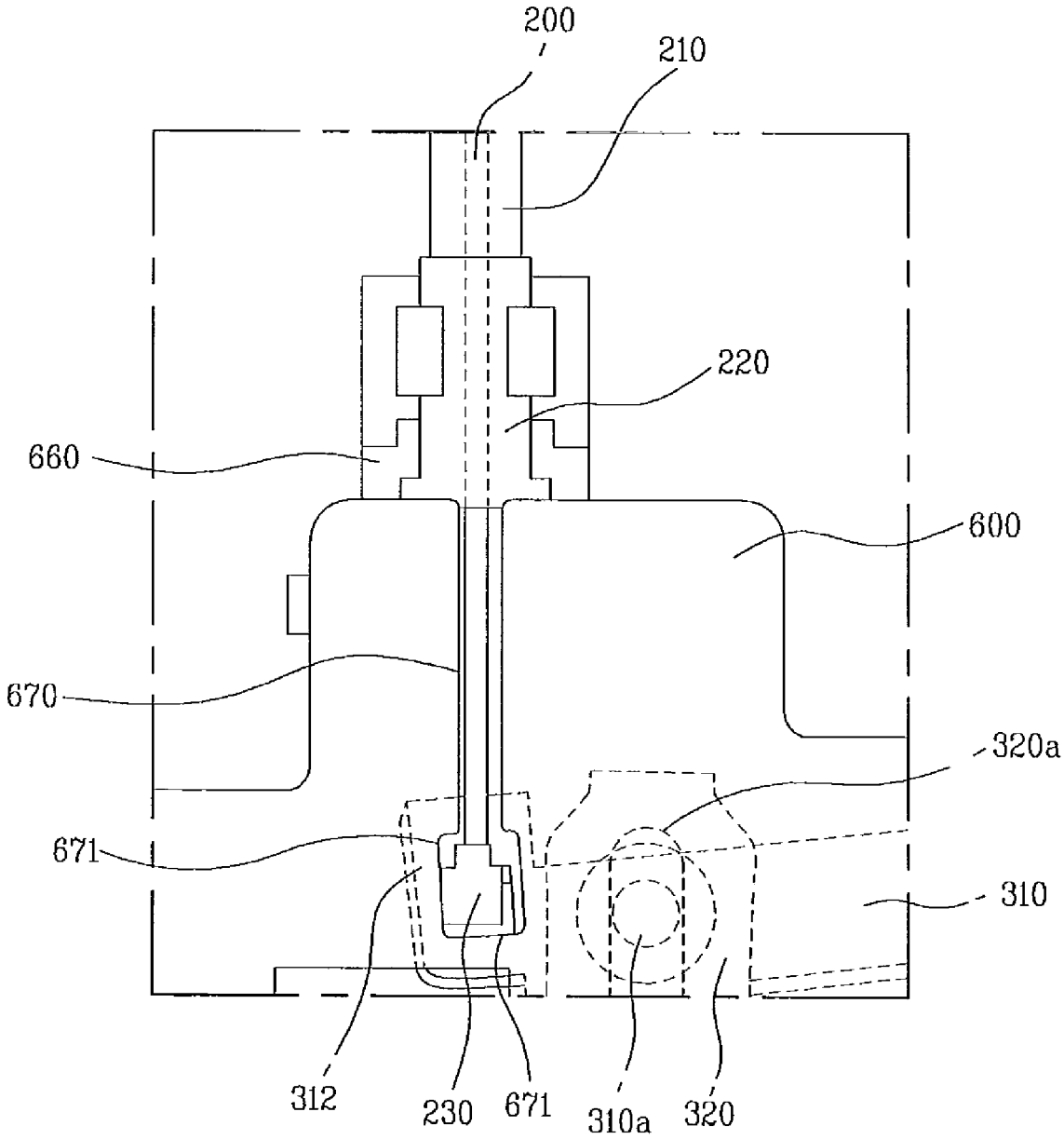
FIG. 9 illustrates a front view of a portion where the cable and the door switch assembly case are connected.

Referring to FIG. 9, it is possible to connect the cable 200 to the cable lever 300 from an outside of the case 600 of the door switch assembly 10.

In more detail, the case 600 may have an inserting hole 671 in one side for enabling the connecting member 230 to be placed in the case. Along with this, the one side of the case may have a slot 670 formed parallel to an extension direction of the cable. The slot 670 can be formed by recessing an inside of the case. And, the slot is configured to limit the left and right direction movement of the cable. Therefore, it is desirable that the slot is provided along the longitudinal direction of the cable.

In this case, the cable 200 can be connected/disconnected to/from the switch unit 300 in the case from an outside of the case 600. Accordingly, if the cable 200 is out of order or a change of a mounting position is required, only the cable 200 can be removed for adjustment of a length. That is, since no disassembling the case 600 is required, the connection/disconnection of the cable 200 to/from the switch unit 300 is very easy.

In the meantime, a covering portion 210 may be provided to an outside of the cable 200. Because, the cable 200 adjacent to the drum and so on which holds the laundry, is liable to be damaged by water or the other reasons.

Opposite ends of the covering portion 210 are fixedly secured to the case 150 (See FIG. 5) of the opening operation unit 100 and the case 600 respectively, and the cable 200 is extended further and connected to the slider 130 (See FIG. 5) of the opening operation unit 100 and the cable lever 310 in the case 600.

In this instance, the opposite ends or one end of the covering portion 210 may have a holder 220 coupled to the case 600 or the case 150. The holder 220 may be placed in a holder receiver 660 in the case 600 or opening operation unit case 150.

If the tension takes place cumulatively in view of properties of the cable 200, the cable 200 is liable to cause plastic deformation, to elongate longer than an initial length. The deformation becomes the greater as the length of the cable 200 is the longer. According to this, proper transmission of the position change from the opening operation unit 100 to the switch unit 300 may fail. Therefore, it is required to minimize a length tolerance for the cumulative cable deformation.

As described before, the opening operation unit 100 and the switch unit 300 are spaced from each other, and the cable is provided with the covering portion 210, the holder 220 in most of sections of the cable. The covering portion has holders 220 at opposite ends, and the holder is secured to the holder receiver 660. According to this, the plastic deformation of the cable is minimized. Therefore, the tolerance for the cumulative cable deformation can be made to the minimum.

The cabinet 20 of the laundry machine has a humid environment. The moisture is condensed by hot water or hot air and infiltrates into the case 600 along the cable 200, particularly the covering portion 210. Electric components and metallic components, such as springs, may be in the case 600. Therefore, it is required to discharge water drops from the case 600 to an outside of the case 600.

To do this, a drain rib 640 (See FIG. 2) may be provided to a lower end of the cable 200, particularly, to a lower side of the cable receiver 312, for discharging the water drops infiltrated thereto along the cable 200 to an outside of the case 600. The drain rib 640 may be sloped downward. According to this, the water drops can be drained to an outside of the case 600 through the inserting hole 671 via the drain rib 640.

Therefore, the inserting hole 671 in the case 600 enables connection of the cable 200 to the cable lever 310 from an outside of the case, and drainage of the water drops infiltrated thereto along the cable to an outside of the case.

Other components of the switch unit 300 will be described in detail with reference to FIG. 2.

The switch unit 300 may include a rocking slider 320 connected to the cable lever 310. It is preferable that the rocking slider 320 can move up/down following rotation of the cable lever 310.

The cable lever 310 may have a projection 310*a* (See FIG. 9), and the rocking slider 320 may have a hole 320*a* for inserting the projection 310*a* therein. According to this, following the partial up/down rotation of the cable lever 310, the rocking slider moves up/down. This is similar to a crank shaft structure of a car. However, it is preferable that the hole 320*a* has a shape of a long hole having an up/down direction width greater than a left/right direction width. As described later, this is because it is required to delay translation of the rocking slider 320 when the cable lever 310 moves upward. In this case, while the rocking slider 320 is stationary, the projection 310*a* moves, sliding upward for a limited distance within the hole 320*a*.

The switch unit 300 may includes a cantilever of cam lever 300. The cam lever 300 is provided such that one end thereof is secured to an inside of the case 600, and the other end thereof is movable in up/down or forward/backward.

In more detail, one end of the cam lever 330 may be secured to an inside of the case 600 through an elastic member 331. The elastic member 331 may be a coil spring. That is, it is preferable that the elastic member 331 has restoring natures with respect to compression and elongation of predetermined distances, together with a restoring nature with respect to rotation of a predetermined angle.

However, if the elastic member 331 is excessively long, it is liable that the elastic member 331 sags down by gravity of the elastic member 331 or a load of the cam lever 330, and it is required to set compression and elongation distances and a rotation angle of the elastic deformation within predetermined ranges, respectively. For this, a portion of the elastic member 331 may be inserted in and secured to the cam lever. For fastening the elastic member, a pin 332 may be used.

It is preferable that cam lever 330 is connected to the rocking slider 320 to move together with the rocking slider 320. For this, the cam lever may have a projection (not shown) formed thereon at one side, and the rocking slider 320 may have a hole (not shown) formed therein in conformity with the projection. That is, the connection between the cam lever 300 and the rocking slider 320 may be similar to the connection between the cable lever 310 and the rocking slider 320 described before. Accordingly, if the rocking slider 320 moves up, the cam lever 330 also rotates up, and if the rocking slider 320 returns to an initial position, the cam lever 330 also rotates down.

At the end, the rotation of the cable lever 310 is transmitted to the cam lever 330 by the rocking slider 320, making the cam lever 330 and the cable lever 310 to move similarly.

The switch unit 300 may include a rotation cam 340. The rotation cam 340 may be rotatably mounted adjacent to the inserting hole 610. It may be devised that the rotation cam 340 moves together with the cam lever 300.

Referring to FIG. 2, it is preferable that the rotation cam 340 has a rotation shaft 341 in rear of the inserting hole 610, positioned on a side of the latch inserted in the inserting hole 610 parallel thereto. According to this, the latch 51 inserted thus and the rotation shaft 341 may be perpendicular to each other, substantially. This is for making the rotation cam 340 to rotate when the latch is placed in/out of the inserting hole 610. In other words, this is for the rotation cam 340 to rotate for the latch 51 to be placed in/out of the inserting hole 610.

It is preferable that the rotation shaft 341 is provided with a torsion spring 342. Accordingly, if the rotation cam 340 rotates by an external force, a restoring force can be generated for the rotation cam 340 to return of an initial position.

Figure 4:
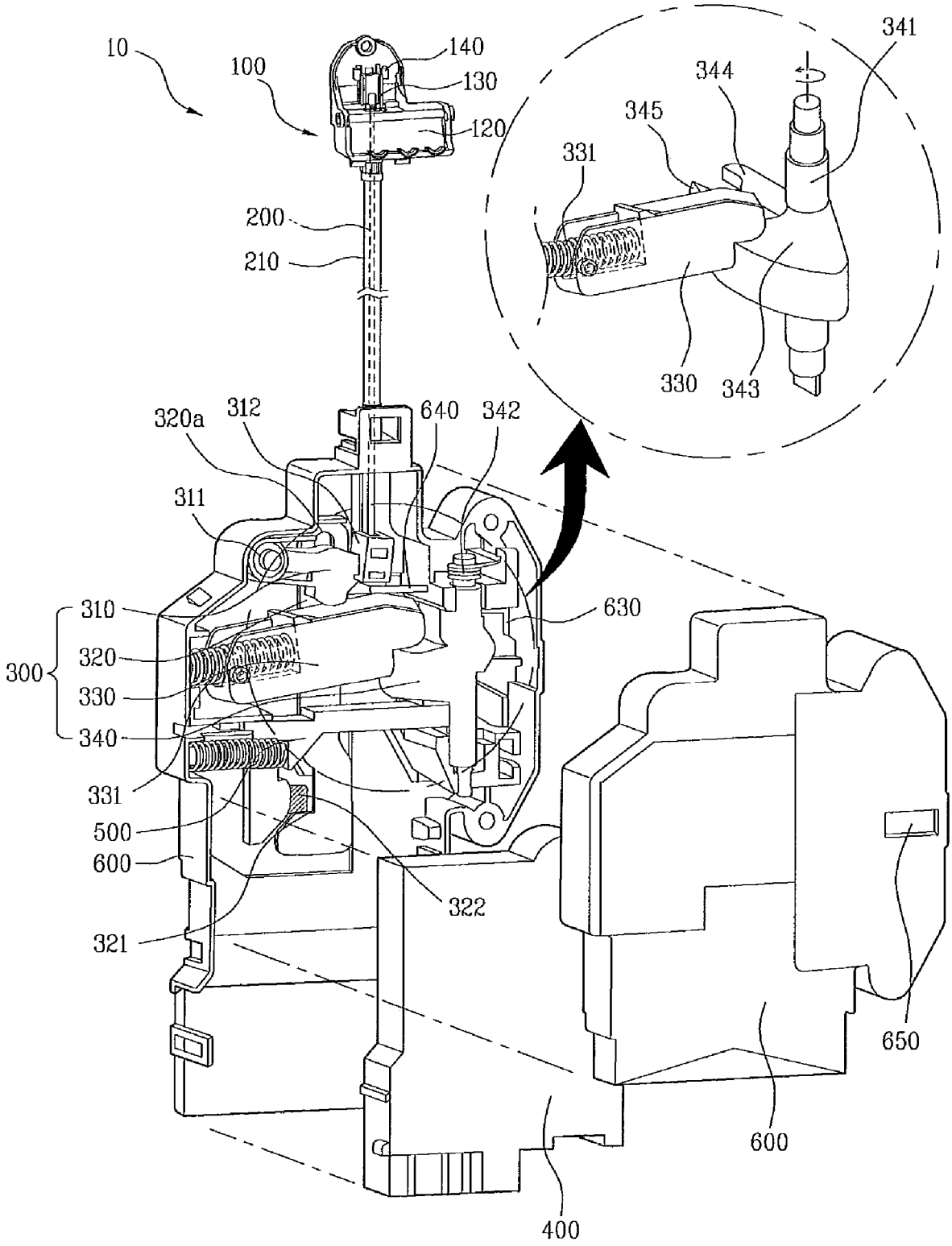
FIG. 4 illustrates a perspective view of the door switch assembly in a state the door is opened, and the force applied to an opening operation unit is removed, with a case of the door switch assembly opened.

In the meantime, it is preferable that the rotation cam 340 has a cam body 343. The cam body 343 may be formed to have a variable radius at a particular position when the cam body 343 rotates round the rotation shaft 341. For an example, as shown in FIGS. 2 and 4, the cam body 343 may be formed to have a fan shape. Along with this, it is preferable that the rotation shaft 341 is provided at an eccentric position of the cam body 343.

Accordingly, following rotation of the rotation shaft 341, the cam body 343 may simply keep in contact with, or push away, the cam lever 330. In the meantime, the cam body 343 may have hooks 344 and 345 at one side for making connection with the latch 51. The hooks 344 and 345 are formed to be exposed to the inserting hole 610 depending on rotation positions of the rotation cam 340, such that the hooks 344 and 345 rotates the rotation cam 340 as the latch 51 of the door 50 is inserted in the inserting hole 610.

It is preferable that the rotation cam 340 has a first hook 344 and a second cam 345. On the whole, the cam body 342 and the hooks 344 and 345 may have a fork shape. In this instance, the first hook 344 may serve to rotate the rotation cam 340 while the first hook 344 is pushed by a front end of the latch 51 when the latch 51 of the door is inserted. The second hook 345, rotating together with the first hook 344, may be inserted in a latching hole 52 (See FIG. 12) to engage with the latch 51 and rotate together with the latch 51.

Therefore, if the latch 51 is inserted in the inserting hole fully, it is liable that, while the second hook 345 is engaged with, and secured to, the latch 51, the first hook 344, being pushed backward by the front end of the latch 51, hits a rear wall of the case 600. In a case the first hook 344 hits the case 600 to cause wear thus, a problem can be caused, in which the first hook 344 fails to be engaged with the front end of the latch 51 at the time the latch 51 is inserted in the door 50, failing the rotation of the rotation cam 340. Therefore, in the embodiment, in order to make the first hook 344 not to interfere with the case 600 even if the first hook 344 rotates to the maximum, the case 600 may have a pass through hole 650 in a rear wall for securing a rotation path of the first hook 344.

Referring to FIG. 2, the door switch assembly 10 has most of components thereof within the case 600. Some of the components move in a width direction of the case within the case 600 or rotate round rotation shafts in a thickness direction of the case. According to this, the case 600 can be thin, to enable to form the case very compact. However, the rotation cam 340 and the hooks 344 and 345, rotating following movement of the latch, move forward/backward in the thickness direction of the case. Therefore, in order to secure such movement adequately, the case 600 is liable to become thicker. Therefore, by forming the pass through hole 650 in the case 600, the case can be prevented from becoming thicker on the whole.

FIG. 2 illustrates the latch 51 of the door 50 inserted in the inserting hole 610.

As described before, as the latch 51 is inserted in the inserting hole 610, the first hook 344 of the rotation cam 340 is pushed backward by the front end of the latch 51, and the second hook 345, engaging with the latching hole 52 in the rotation cam 340, rotates the rotation cam 340 in a clockwise direction. However, it is preferable that, if the latch 51 is inserted in the inserting hole 610, when the door 50 is closing, one side of the cam body 343 is made stationary by the other end of the cam lever 330 to limit a rotation position as the cam body 343 rotates. That is, a state of door 50 closure is maintained.

For this, as described before, it is preferable that the cam body 343 has a fan shape. If the cam body 343 is formed circular centered on the rotation shaft 341, to maintain a fixed distance between the cam lever 330 and the cam body 343 at all rotation positions of the rotation cam 340, the limitation of rotation position of the cam body 343 can not be achieved only by the cam lever 330 supporting one side of the cam body 343. As shown in FIG. 2, by providing the cam body 343 having the fan shape, and making the cam lever 330 to support the one side of the cam body 343, the limitation of rotation position of the cam body 343 can be achieved.

Accordingly, despite of the restoring force for returning to the initial position, the rotation position of the rotation cam 340 is limited, and the door 50 can be fastened to the door switch assembly 10 in a state the latch 51 is engaged with the second hook 345.

However, the shape of the cam body 343 of the present invention is not limited to the fan shape, but varied as far as the rotation position of the cam lever 330 is limited depending on a rotation position of the cam lever 330. For an example, the cam body 343 may also have a shape of ellipse or circular eccentric centered on the rotation shaft, or a stepped portion to vary a radius depending on the rotation positions.

The operation mechanism of the door switch assembly 10 following opening/closing of the door 50 will be described in detail with reference to FIGS. 2 to 4.

FIG. 2 illustrates a state the door 50 is closed. Therefore, if there is no user's operation at the opening operation unit 100, the opening operation unit 100 is in an initial state, and the door is in a closed state with the latch 51 inserted in the inserting hole 610, the rotation cam 340 in a rotated state and the cam lever 340 in a state of limiting the rotation cam 340. Because the restoring force of the cam lever generated as the cam lever is compressed following restoration of the rotation cam 340 is greater than the restoring force of the rotation cam 340.

Figure 3:
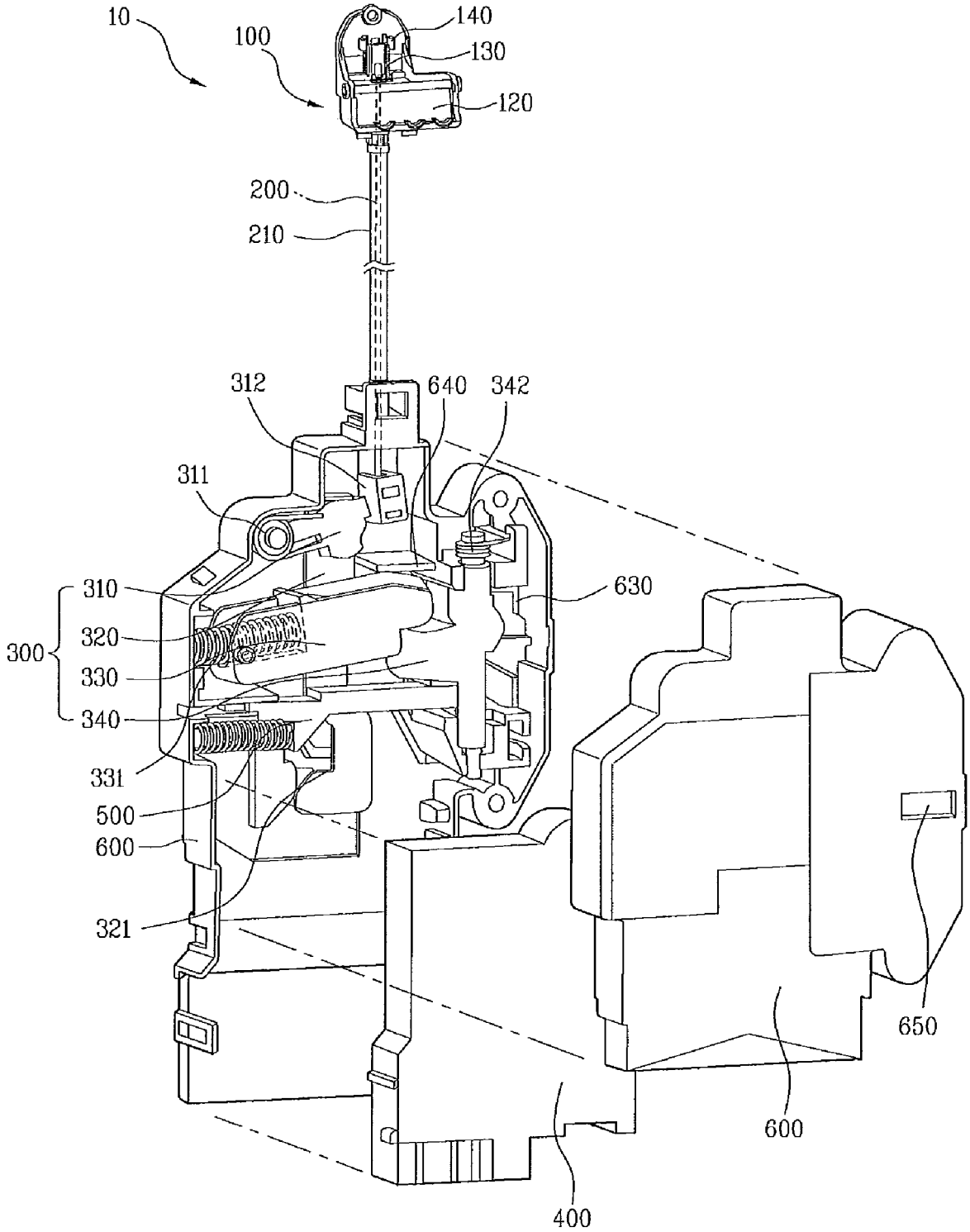
FIG. 3 illustrates a perspective view of the door switch assembly in a state a force is applied to an opening operation unit, with a case of the door switch assembly opened.

FIG. 3 illustrates a state the user operates the opening operation unit 100 for opening the door 50.

If the user applies a force through the opening operation unit 100, the cable 200 is pulled upward, to move the switch unit 300 connected to the cable 200.

At first, the cable lever 310 connected to the cable 200 moves upward. Then, following the upward movement of the cable lever 310, the rocking slider 320 connected to the cable lever 310 moves upward. The cam lever 330 connected to the rocking slider 320 also rotates upward.

When the cam lever 330 rotates upward, the limited state of the rotation cam 340 by the cam lever 330 is released. According to this, the rotation cam 340 can returns to the initial position, i.e., a position before the door 50 is inserted by using the restoring force of the torsion spring 342. In this instance, the latch 51 of the door 50 engaged with the second hook 345 is pushed outward following rotation of the rotation cam 340 in a direction of the cam lever 330, and the door 50 can be opened.

In the meantime, the rotation cam 340 pushes the latch 51 to open the door by the elastic force of an elastic member. The elastic member may be a torsion spring 342. Therefore, the door can be opened by itself. Also, an elastic member, for example a torsion spring (not shown), may be provided at the door hinge 53 to generate elastic force to the opening direction of the door. Accordingly, it is possible to omit a door handle in order to enhance the appearance of the laundry machine.

FIG. 4 illustrates a state the door 50 opened, and the force applied to the opening operation unit is released.

That is, if the force which pulls the cable 200 through the opening operation unit 100 is removed, the cable lever 310 rotates downward by the restoring force of the first torsion spring 311 of the cable lever 310, and the cable 200 changes a position downward.

Accordingly, the rocking slider 320 moves down, and the cam lever 330 also rotates down, to return the rotation cam 340 to the initial state. Since the elastic force is removed from the elastic member 331 of the cam lever 330, a total length of the cam lever 330 becomes the longest. Therefore, the other end of the cam lever 330 returns to the initial position of an upper side of the cam body 343. As shown in FIG. 4 well, this state is a state the cam lever 330 is bent upward, tending to move down by gravity and the restoring force of the elastic member 331.

In the meantime, the rotation cam 340 rotates when the door 50 is closing again, and at the moment the door is closed fully, the cam lever 330 can return to the initial state. It is preferable that the cam body 343 is formed taking this into account.

In this instance, the cam lever 330 moves down from an upper side of the rotation cam 340 to a side of the rotation cam 340, with a clicking sound coming from the elastic restoring force. The user can know that the door 50 is closed clearly from sense by the sound. A state thereafter, i.e., a state the door is fully closed is illustrated in FIG. 2.

As described before, the elastic force from the cam member is greater than the restoring force of the rotation cam 340. Therefore, as far as no more force is applied to the door, the door is not opened.

However, in a case the door is closed with a child in the drum, it is desirable that the child can open the door. That is, it is desirable that the door 50 can be opened from an inside of the drum by a force the child can push the door 50. For this, an elastic modulus of the elastic member 331 of the cam lever 330 can be selected.

The greater the elastic modulus, the greater the force required for opening the door, and the lower the elastic modulus, the lower the force required for opening the door. However, if the elastic modulus is low excessively, the clicking sound described before will become very low, making whether the door is closed or not to be very difficult. The elastic modulus can be selected appropriately, taking all these situations into account.

Besides above system of the door switch assembly 10, the door switch assembly 10 may include a locking unit 400 for maintaining a locking state of the door 50. The locking unit 400 may be provided by limiting mechanical movement of the switch unit 300.

Preferably the locking unit 400 may be devised not to open the door 50 during washing operation. That is, it is preferable that it is made that the user can not open the door by holding the door as well as even by means of the opening operation unit 100 described before during the washing operation.

Of course, during the washing operation, power is applied to the laundry machine. Therefore, it is preferable that the power is applied to the locking unit 400 during the washing operation only. Accordingly, it can be devised that the locking unit 400 can be operated during the washing operation only. By this, a locking state of the door 50 can be maintained selectively taking a driving state of the laundry machine.

In a case of black out, since the power is cut off for the laundry machine itself, releasing the locking state automatically as no power is supplied to the locking unit 400, the door 50 can be opened by pressing the opening operation unit 100. Accordingly, leaving the laundry within the laundry machine for a long time can be prevented, which is caused by the laundry machine being out of order, or the like.

An operation principle of the locking unit 400 will be described in detail with reference to FIG. 2. For reference, FIG. 2 illustrates a state the locking unit 400 is separated from the switch unit 300.

The locking slider 320 may include a holding portion 321 adjacent to the locking unit 400. The holding portion 321 may be formed in a shape a lower side of the rocking slider 320 is bent. A locking pin 410 (See FIG. 10) may be mounted to a position facing the holding portion 321 of the rocking slider 320. In this instance, the locking pin 410 may be devised to be projected and returned to/from a hatched portion 322 in FIG. 2.

As described before, for opening the door, the cam lever 330 moved up is required to move up. For moving up the cam lever 330, the rocking slider 320 is required to move up. Therefore, if moving up of the rocking slider 320 is limited, the door locking state can be maintained.

In the meantime, the rocking slider 320 is connected to the cable lever 310. Therefore, if moving up of the rocking slider 320 is limited, the moving up of the cable lever 310 will also be limited. However, the moving up of the cable lever 310 can be made by operation of the opening operation unit 100, it is required to permit a distance of moving up of the cable lever 310. Because, if the cable lever 310 does not move in a door lock state, the cable 200 and the opening operation unit 100 do not move. Accordingly, it is liable that a very strong force can be applied to the opening operation unit 100, to apply a strong tension to entire system, to damage the door switch assembly 10. Moreover, if the opening operation unit 100 does not move at all, the user can determined that the opening operation unit 100 is out of order by misunderstanding.

Therefore, in a locking state of the door 50, it is required to permit operation of the opening operation unit 100, and moving up of the cable 200 and the cable lever 310 within a limited range. Of course, in this instance, the rocking slider 320 and the cam lever 330 do not move.

For this, as described before, the locking slider 320 has the long hole 320*a* formed therein, and the projection 310*a* of the cable lever 311 is slidably connected within the long hole 320*a*.

In this case, by limiting a path in which the rocking slider 320 can move up following movement of the locking pin 410 according to application of power to the locking unit 400, movement of the switch unit 300 can be limited.

That is, even if the user presses the opening operation unit 100, as movement of the rocking slider 320 is limited by the locking pin 410, the door 50 is not opened. According to this, accident caused by negligence of safety can be prevented.

The locking unit 400 will be described with reference to FIG. 10.

The locking unit 400 has a locking pin 410 mounted therein movable under electric control. If power is applied, the locking pin 410 can pass through a hole (not shown) in a front case (not shown) of the locking unit 400 and project to limit the moving up of the rocking slider 320. In this instance, the locking pin 410 projects to the holding portion 321 of the rocking slider 320 to limit the moving up of the rocking slider 320. If the power is cut off, the locking pin 410 returns to permit opening of the door 50, enabling movement of the rocking slider 320. That is, as the locking pin 410 moves perpendicular to a moving direction of the rocking slider 320, the moving up of the rocking slider 320 can be limited.

It is a prerequisite that the power applied to the locking unit 400 is a main power applied to the laundry machine. Therefore, when the main power is cut off or in a black out, of course, the power to the locking unit 400 is cut off. However, even if the main power is applied, there is a case when the user needs to open the door at the time of finishing the washing operation or temporary stop of the washing operation. In this case, the controller (not shown) of the laundry machine is devised to apply the power to the locking unit 400, selectively.

The locking unit 400 may include a position adjusting unit which can control forward/backward movement of the locking pin 410, additionally. The position adjusting unit may include bi-metal or solenoid for controlling a position of the locking pin 410 under an electrical control.

For an example, as the position adjusting unit, a lifter 420 of bi-metal may be provided. The bi-metal uses two metal having different coefficients of thermal expansion for having a characteristic in which the bi-metal bends in a specific direction if a temperature rises, and returns to an original shape if the temperature returns.

Figure 10:
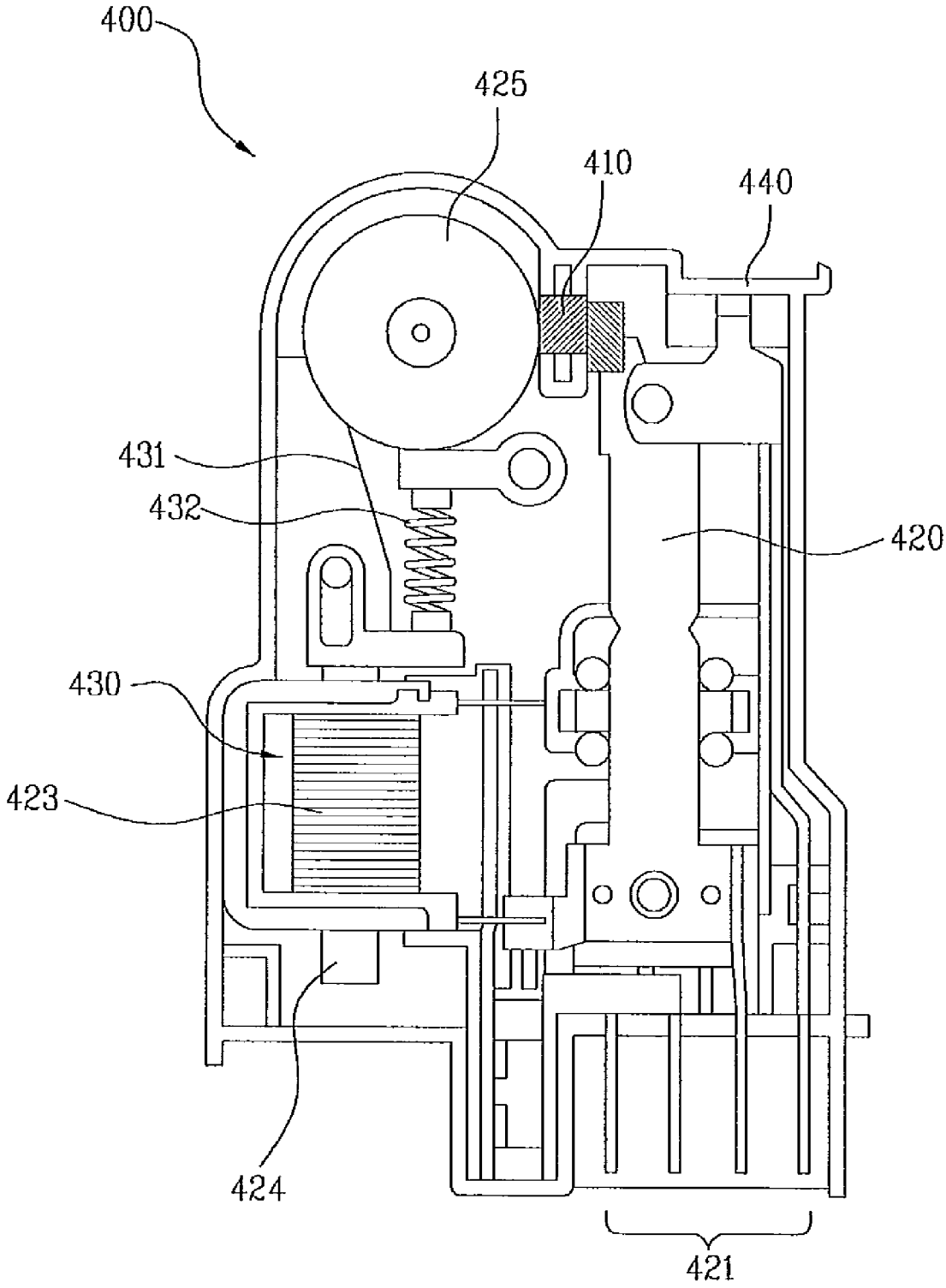
FIG. 10 illustrates a front view of an inside of the locking unit in FIG. 2.

Referring to FIG. 10, the lifter 420 may be connected to terminals 421 adjacent to the locking pin 410 having the power applied thereto. Accordingly, in a case the power is applied to the locking unit 400, the lifter 420 is involved in temperature rise to bend forward, and no power is applied thereto, the lifter 40 is involved in temperature drop, to return to an original shape. In this instance, as means for applying heat, a PTC heater may be used. The PTC heater generates heat if the power is applied thereto to cause the bending of the bi-metal. If the power is cut off, the PTC heater is cooled down to cause the returning of the bi-metal to an initial position. According to this, in conformity with the bending and returning of the lifter 420, the locking pin 410 can be projected/returned.

However, due to characteristic of the bi-metal, the temperature of the lifter 420 drops slowly if the power is cut off in the middle of application of the power, to require a time period for the locking pin moved up thus to return to the original position. Therefore, there is a problem in that the door 50 can not be opened for a time period even after the driving is finished.

Accordingly, the locking unit 400 may include a locking release unit 430 for making forced release of the locking state of the door 50. That is, a system for making forced returning of the locking pin 410 may be provided, additionally. The locking release unit 430 may be provided in a case 440 together with the lifter 420 different from the switch unit 300 and so on.

The locking release unit 430 has the power applied thereto selectively through the controller. Therefore, the controller applies the power to the locking release unit 430 for making forced release of the locking in predetermined cases of just after finish of the washing operation, pause of the washing operation, and so on. According to this, the user can open the door without waiting for the lifter to return to an original position.

The locking release unit 430 may include a solenoid 423 and a conductor 424 which moves following application of power to the solenoid 423. According to this, the locking pin 410 can be designed to move together with the conductor.

That is, if the power is applied to the solenoid 423 for making forced release, the conductor moves to make the locking pin 410 to move forcibly. Thereafter, if the power to the solenoid is cut off, the conductor can return by an elastic member or the like. In this instance, since the temperature of the lifter 420 drops adequately, despite of the return of the conductor, the locking pin 410 can maintain a returned state.

In the meantime, referring to FIG. 10, there can be a variety of components disposed between the conductor 424 and the locking pin 410.

It can be devised that, if the power is applied to the solenoid 423 to make the conductor 423 to move down, a wire 432 is pulled, and a reel 425 may be provided for turning the reel 425 following the pulling of the wire 423, additionally. In this instance, it can be devised that the locking pin 410 returns by anti-clockwise rotation of the reel.

In the meantime, the power to the solenoid 423 is cut off, the conductor 423 can return to an initial position. For this, an elastic member 432 may be provided between the conductor 423 and the reel 425. In this instance, it is liable that the locking pin 410 moves down by clockwise direction rotation of the reel 432 due to slack of the wire 423. In order to prevent this from taking place, the cam 425 may have teeth (not shown) sloped upward in a rotation direction, to make the locking pin 410 to return if the cam 425 rotates in an anti-clockwise direction, and to make the locking pin 410 not to rotate if the cam 425 rotates in clockwise direction.

Therefore, if the devise is provided, the locking state can be released instantly by a signal from the controller without waiting until a time when the temperature of the lifter 420 drops.

In this instance, the locking unit may be provided with a contact point (not shown) devised to make a current to flow thereto in a turn on state. The contact point may be devised to turn on at a position where the locking pin 410 limits the movement of the switch unit 300, i.e., at a limiting position. Therefore, the contact point is turned off in the middle of movement of the locking pin 410 to the limiting position, or at the moment the locking pin 410 is returned to the limiting position. The controller may be designed to apply the power for enabling the washing operation if the contact point is turned on, and to cut off the power to stop the washing operation if the contact point is turned off.

In the meantime, a case can happen when the door 50 of the laundry machine is opened accidently by an external impact or the like. It is preferable that the washing operation is stopped when the door 50 opens accidentally thus, for preventing accident caused by negligence of safety from taking place as the drum can rotate.

Therefore, the door switch assembly 300 may include an opening/closing detecting unit 500 for sensing opening/closing of the door 50. It is preferable that if the opening/closing detecting unit 500 senses the accidental opening of the door 50, the controller controls to finish the washing operation. In this case, the controller can end the washing operation determining that the contact point is turned off.

The opening/closing detecting unit 500 will be described with reference to FIGS. 2 and 10.

The opening/closing detecting unit 500 may have one end provided to the inserting hole 610. In detail, the one end of the opening/closing detecting unit 500 is formed to be exposed to the inserting hole 610, and the other end thereof may be connected to an elastic member 510 secured to the inside of the case 600.

The one end of the opening/closing detecting unit 500 to a side of the inserting hole 610 if the door 50 is not closed. However, if the door 50 is closed making the latch 51 to be placed in the inserting hole 610, the opening/closing detecting unit 500 is pressed by the latch 51 to slide in a vertical direction of a direction in which the latch 51 is inserted, i.e., to the inside of the case 600. Therefore, depending on the slide of the opening/closing detecting unit 500, the opening/closing of the door 50 can be sensed.

In this instance, it is preferable that a sliding path of the opening/closing detecting unit 500 is formed by using components in the case 600, such as the rib. It is more preferable that the one end exposed to a direction of the inserting hole 610 has a cross section in contact with the latch 51 sloped in a direction of the sliding so that the one end slides toward an inside while the end is pushed backward by the latch 51 in a case the door 50 is closed.

If the accidental opening of the door 50 is sensed by the opening/closing detecting unit 500, it is preferable that the laundry machine is controlled to forcibly end the washing operation.

The opening/closing detecting unit 500 may be connected to the controller electrically to provide a forcible end signal to the controller, directly. The opening/closing detecting unit 500 may be connected to the controller 500 electrically by using the locking unit 400.

The opening/closing detecting unit 500 may include a locking release rib 520 extended in a vertical direction to a direction of the sliding, additionally. The locking release rib 520 slides together with the opening/closing detecting unit 500 depending on opening/closing of the door 50.

In this instance, it is preferable that, while the locking release rib 520 is positioned spaced from a point 520 where the locking pin 410 is projected in a state the door 50 is closed, if the door 50 is opened accidently, the locking pin 410 slides toward the point 50 where the locking pin 410 is projected. The accidental opening of the door 50 is, for an example, an opening of the door in the middle of the washing operation. That is, since the locking state of the door 50 is maintained during the washing operation, the locking pin 410 is in a projected state.

Figure 11:
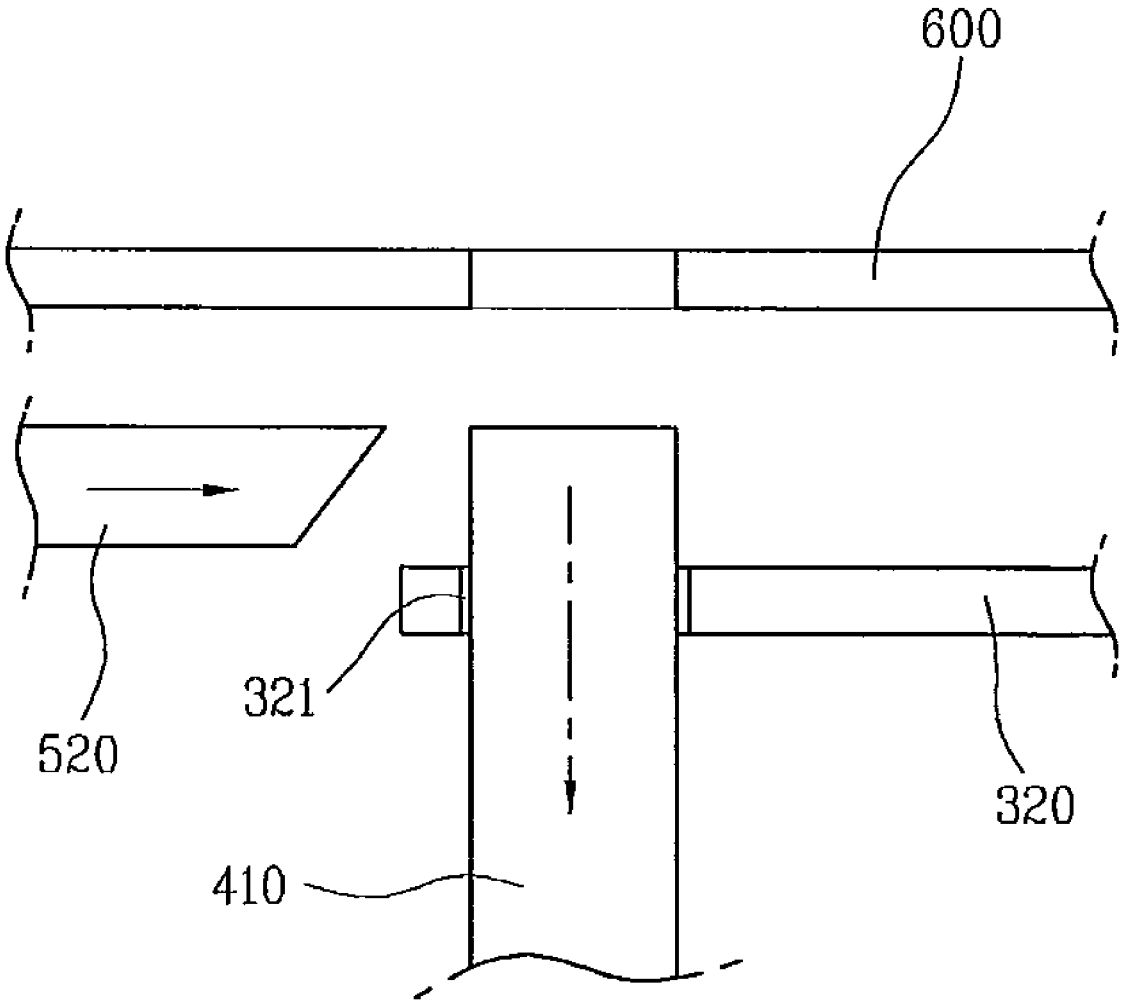
FIG. 11 illustrates a section across a line A-A' in FIG. 2.

FIG. 11 illustrates a section across a line A-A' in FIG. 2. However, though FIG. 2 illustrates a state the locking unit 400 is separated, FIG. 6 illustrates a section showing a state the locking unit 400 is coupled for showing a relation of position to the locking pin 410.

FIG. 2 illustrates a state the door 50 is closed, wherein the locking pin 410 of the locking unit 400 is projected as shown in FIG. 6 in the washing operation.

As the door 50 is closing, the opening/closing detecting unit 500 slides toward the inside of the case 600, the locking release rib 520 is secured in a state spaced from a position of the locking pin 410, and the rocking slider 320 is in a state the up/down movement of the rocking slider 320 is limited by the locking pin 410.

If the door 50 is opened accidentally, as the opening/closing detecting unit 500 slides toward the inserting hole, the locking release rib 520 also slides to press the locking pin 410, to make the locking pin 410 to return to the inside of the locking unit 400. That is, if the door 50 is opened accidentally, causing to fail the moving down of the locking pin 410 by the position adjusting unit, the locking state of the locking unit 400 can be released forcibly by the locking release rib 520 of the opening/closing detecting unit 500.

It is preferable that the locking release rib 520 has a sloped surface sloped from a lower side to an upper side for making easy return while pressing the locking pin 410. In this case, the pressing is progressed slowly starting from a top of the locking pin 410, enabling to return the locking pin 410 without interference.

Thus, in the case the door 50 is opened accidentally, the opening/closing detecting unit 500 can transmit a fact of opening of the door 50 caused by a forced release of the locking state of the locking pin 410 to the locking unit 400.

The locking unit 400, electrically connected to the controller for transmission/reception of a signal, can transmit a driving stop signal to the controller is the locking state is released forcibly for stopping the driving of the laundry machine. That is, the controller applies power to the locking unit 400 to project the locking pin 410 at the time of the washing operation for maintaining the door locking state, opposite to this, cuts off the power to the locking unit 400 to return the locking pin 410 at the time of finish of the washing operation for releasing the door locking state. Therefore, since the controller controls to progress the washing operation on an assumption that the locking pin 410 is projected, if the locking pin 410 is returned forcibly, the controller can control to stop the washing operation forcibly.

Different from above, the locking unit 400 may have a cutting off unit (not shown) for cutting off power supply to the driving unit of the laundry machine. In this case, it is possible to devise such that, if the opening/closing detecting unit 500 releases the locking state forcibly, the power supply to the driving unit is cut off by using the cutting off unit. The cutting off unit may be provided in a shape of a switch moving together with the opening/closing detecting unit 500, mechanically.

Therefore, the contact point may be provided such that the controller detects a state of the contact point for supplying power to the driving unit selectively, or applies or cutting off, the power to the driving unit directly by turning on/off the contact point.

However, this in exemplary, it is of course viable that the opening/closing detecting unit 500 is a sensor (not shown) mounted adjacent to the door or the like, and the opening/closing detecting unit 500 transmits a signal that the door 50 is opened accidentally to the controller directly.

Relation of operation of the locking unit and the opening/closing detecting unit with respect to opening/closing of the door will be described.

At first, if the door is closing, the opening/closing detecting unit slides toward the inside of the case.

If the washing operation starts, following power application to the locking unit 400, the locking pin projects to limit the moving path of the rocking slider. According to this, during operation of the laundry machine, the locking state is maintained by the locking pin, in which the switch unit is not movable. That is, the PTC generates heat to bend the bi-metal, moving the locking pin 410 to maintain the locking state.

If the washing operation is finished or stops temporarily, the power to the locking unit 400 is cut off to return the locking pin 410 to an initial position. Accordingly, the locking state is released. However, in order to release the locking state instantly, the controller determines whether the power to the PTC is cut off or not. If the power to the PTC is cut off, the controller controls such that the locking pin 410 returns to the initial position, forcibly. Of course, along with this, the controller will be required to determine whether the washing operation is being made or not. That is, if the washing operation is stopped or finished, and the power to the PTC is cut off, the controller puts the solenoid into operation regardless of the return of the locking pin 410 to the initial position by the bi-metal.

Therefore, since the locking state is released, the user may operate the opening operation unit 100, to open the door 50. In a case the door is opening, the opening/closing detecting unit 500 slides to the direction of the inserting hole 610 by the restoring force of the elastic member 510. However, since this is a state the locking pin 410 has returned already, the locking release rib 520 does not press the locking pin.

In the meantime, if the door is opened accidentally in the middle of operation, the locking pin 410 can not return because the locking unit 400 is in a state the power is being applied thereto. Therefore, as the opening/closing detecting unit 500 slides toward the direction of the inserting hole due to the accidental opening of the door, the locking release rib 520 presses the locking pin 410 to return forcibly. Then, it is possible that the opening/closing detecting unit 500 transmits the signal for stopping the washing operation to the controller as the power is cut off due to the forcible return of the locking pin, or cuts off the power to the driving unit of the laundry machine directly through the cutting off unit.

In the meantime, if the door 50 is opened automatically by mechanical operation of the door switch assembly 10, it is preferable to reduce friction for minimizing the friction at the time of opening/closing the door 50.

Details of the inserting hole 610 and the latch 51 devised to minimize the friction will be described with reference to FIGS. 12 and 13.

The friction force between the inserting hole 610 and the latch 51 prevents the door opening. As described above, elastic members may be provide to open the door when the locking state of the door is released. Therefore, it is very important to reduce the friction force.

It is preferable that the case 600 is formed to minimize a contact area to the latch 51 at a portion adjacent to the inserting hole 610.

As described before, it is preferable that the inserting hole 610 is formed on one side of the case 600, and a periphery of the inserting hole 610 has a sloped surface 620 sloped outwardly. Accordingly, the inserting hole 610 may have a shape in which the inserting hole 610 becomes the smaller as the inserting hole 610 goes to an inner side from an outer side the more.

Figure 12:
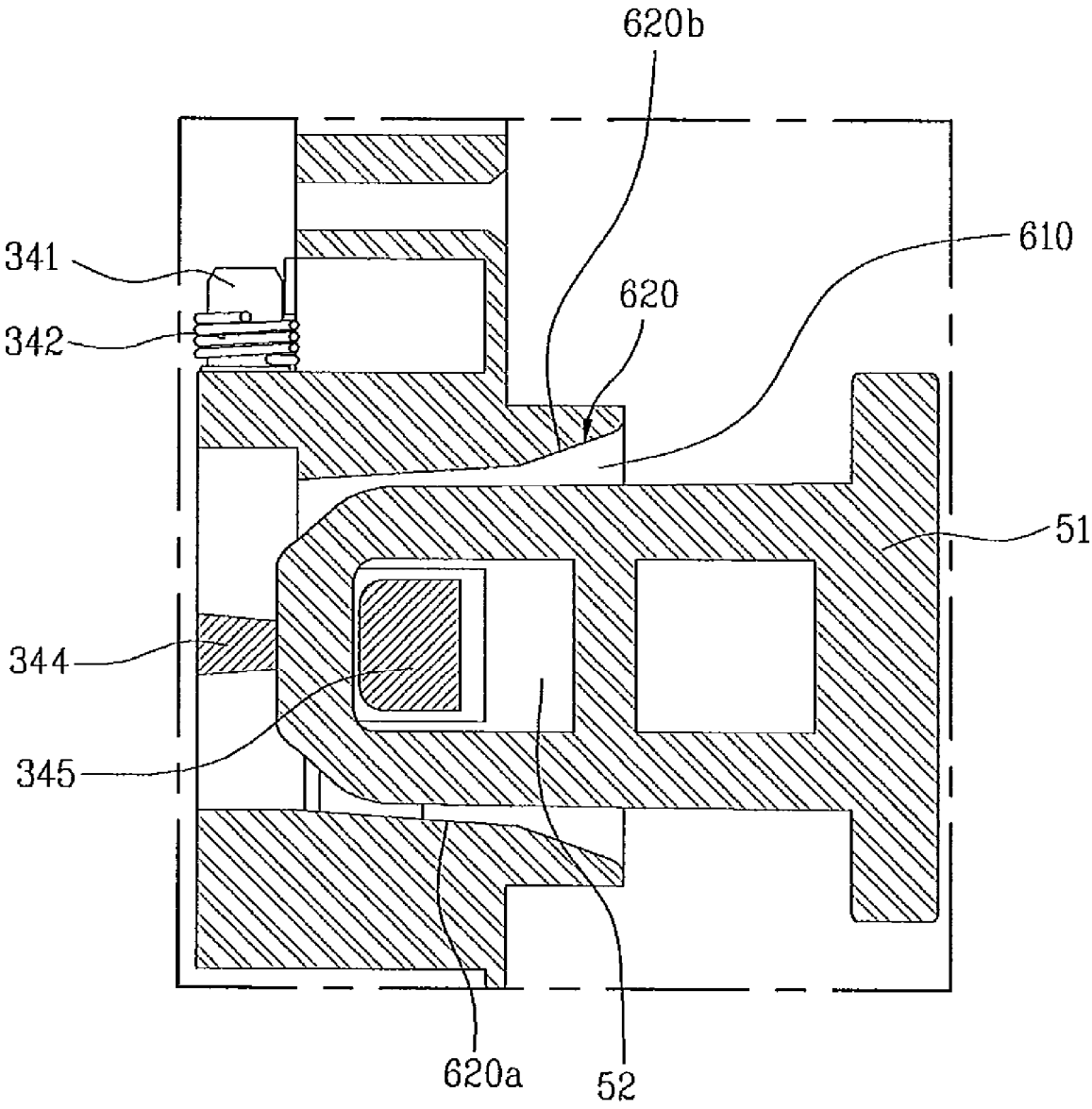
FIG. 12 illustrates a longitudinal section in a state a latch is placed in an inserting hole in FIG. 1.

Referring to FIG. 12, a lower side sloped surface 620*c* of the inserting hole 610 may be sloped in downward outwardly, and an upper side sloped surface 620*b* of the inserting hole 610 may be sloped upward. In this case, even if the latch 51 is brought into contact with the sloped surface 620 as the latch 51 is inserted into the inserting hole 610, since the contact is, not a surface contact in which a surface contacts with an opposite surface, but merely a line contact in which a line contacts with an opposite line, the friction that interferes movement of the latch 51 can be minimized.

It is more preferable that the latch 51 may have a shape in which a thickness thereof becomes the thinner as the latch 51 goes to an edge direction the more. In this case, a length of the line contact to the sloped surface 620 can also be reduced as the latch 51 is inserted into the inserting hole 610.

In the meantime, it is preferable that an outer side slope of the lower side sloped surface 620*c* is formed greater than an inner side slope of the lower side sloped surface 620*c* so that the latch 51 can be inserted in the inserting hole 610 even if the door 50 sags by gravity.

In general, the door 50, mounted with a member, such as a hinge at one side thereof, has a portion where the latch 51 is connected thereto liable to sag down by gravity of the door 50 if the door 50 is used for a long time. Therefore, if the sag down of the door is heavy, the latch 51 is liable to interfere with a lower portion of the inserting hole 610, preventing the door 50 from proper closing. Therefore, in order to compensate for a predetermined amount of sag, the lower side sloped surface 620*c* may be formed to slope outwardly.

In this case, the greater the outward slope, the heavier sag of the door 50 can be compensated. However, because the greater the outward slope of the lower side sloped surface, the greater a size of the inserting hole, making beauty the poorer.

Therefore, it is preferable that the lower side sloped surface 620*a* has a great slope on an outer side, and a small slope on an inner side. In this case, even if the door 50 sags, the latch 51 can be inserted to an inner side of the inserting hole 610 following the sloped surface formed great on a lower side, and can be lead to a latching position with the second hook 345 along a moderately sloped surface as the latch 51 advances to the inner side.

In this instance, the lower side sloped surface 620*c* may have two sloped surfaces having slopes different from each other, or a sloped surface curved the greater as the sloped surface goes toward outwardly the more.

Figure 13:
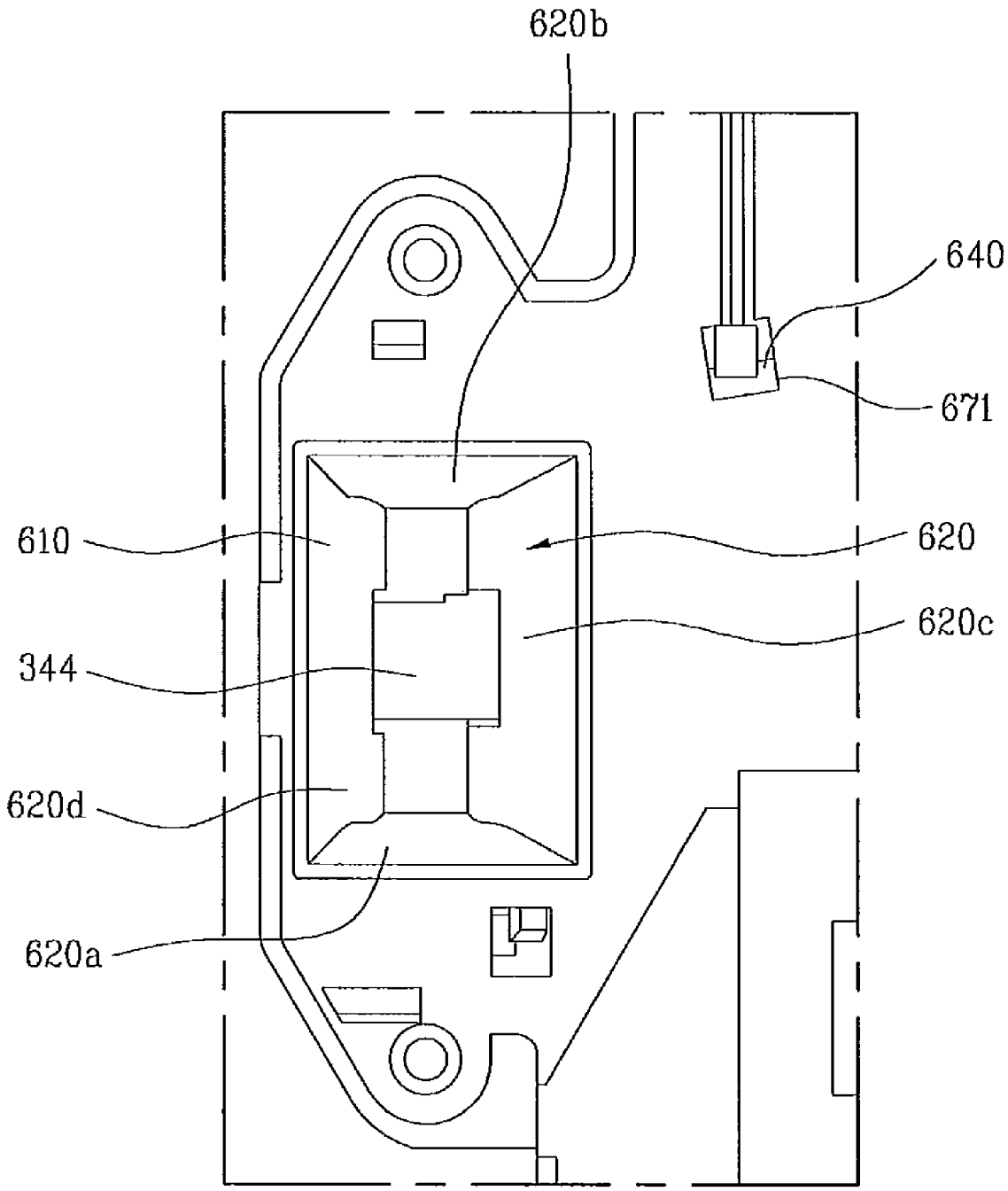
FIG. 13 illustrates a front view of an inserting hole.

In the meantime, FIG. 13 illustrates the sloped surfaces formed on opposite sides of the inserting hole 610.

The latch 51 rotates along a radial path following rotation of the door 50. Therefore, if there is no sloped surface in a periphery of the inserting hole additionally, it is liable that the latch can interfere with the case 600 as the latch is being inserted into the inserting hole 610. Particularly, since the latch 51 moves while drawing a radius in an outside direction at a position ahead of the door 50 by a predetermined angle than the door 50, of the opposite sloped surfaces 620*c* and 620*d*, the latch 51 can interfere with the sloped surface 620*c* formed on an outer side of a radius of rotation of the door 50.

Therefore, it is preferable that the opposite sloped surfaces 620*c* and 620*d* have slopes different from each other, and more preferably the sloped surface 620*c* on the outer side of the rotation radius of the door 50 has a greater slope. Accordingly, if the door 50 is closing, the latch 51 can enter into the inserting hole 610 without interfering with the sloped surface 620*c*.

This can be described as follows. That is, the inserting hole 610 is asymmetry with reference to a center of the latch 51 inserted in the inserting hole 610. That is, a width of the inserting hole 610 on an outer side of a door rotation radius is formed greater than a width of the inserting hole 610 on an inner side of the door rotation radius. Owing to this, the slope of the outer side sloped surface 620*c* of the door rotation radius can be greater than the slope of the inner side sloped surface 620*d* of the door rotation radius. Therefore, the friction between the latch 51 and the inserting hole 610 liable to cause as the latch 51 is being inserted into the inserting hole 610 can be minimized.

In the meantime, it is preferable that there is a moving preventive rib 630 (See FIG. 2) extended backward by a length from an end point of the sloped surface 620 in rear of the inserting hole 610. That is, the moving preventive rib 630 may be provided to support one side of the latch 51 inserted thus. According to this, vibration of the latch 51 generated when the laundry machine is driven can be minimized as the latch 51 is secured by the moving preventive rib 630.

As has been described, the laundry machine of the present invention has the following advantages.

First, the user's easy opening and closing of the door permits to provide a laundry machine of which use is convenient.

Second, the mechanical door switch permits to provide a laundry machine having enhanced endurance and safety.

Third, since the door can be opened even from an inside of the drum easily, a laundry machine can be provided, which can prevent an accident caused by negligence of safety by a child from taking place.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet;

a drum rotatably mounted in the cabinet;

a door having a latch configured to be opened/closed selectively to expose an inside of the drum to outside of the laundry machine; and a door switch assembly provided to enable opening/closing of the door, wherein the door switch assembly includes:

a switch unit configured to be connected selectively to the latch;

an opening operation unit spaced from the switch unit for a user to enable an opening operation of the door;

a cable configured to transmit a linear position change generated by the opening operation unit to the switch unit; and a case configured to house the switch unit, the case having an insertion hole to be inserted the latch therein, wherein the switch unit includes a cable lever having one end rotatably secured, and the other end connected to the cable to generate a rotational position change according to the linear position change of the cable, and wherein a connecting member is provided at an end of the cable to enlarge the cross section of the cable, and the cable lever includes a cable receiver at the other end for inserting and securing the connecting member.

2. The laundry machine as claimed in claim 1, further comprising a control panel on an upper side of the cabinet for interfacing with a user, the opening operation unit being provided at the control panel.

3. The laundry machine as claimed in claim 1, wherein the opening operation unit includes a lever which generates a rotational position change by operation of the user.

4. The laundry machine as claimed in claim 3, wherein the opening operation unit includes a button which generates a linear position change by operation of the user, wherein the linear position change induces the rotational position change of the lever.

5. The laundry machine as claimed in claim 4, wherein the button is provided to be exposed to a front of the cabinet.

6. The laundry machine as claimed in claim 4, wherein the opening operation unit includes a slider which generates up/down direction linear position change according to the rotational position change of the lever.

7. The laundry machine as claimed in claim 6, wherein an inserting portion is provided in the lever and an inserting slot is provide in the slider to receive the insertion portion, the inserting portion sliding inside the inserting slot at the time the lever rotates.

8. The laundry machine as claimed in claim 7, wherein the inserting slot has a lower side rounded opening.

9. The laundry machine as claimed in claim 8, wherein the lever has a reinforcing rib provided inside of the lever, the rib having a curved portion in conformity with the lower side opening.

10. The laundry machine as claimed in claim 1, wherein the case includes an inserting hole configured to insert the connecting member from an outside to an inside of the case.

11. The laundry machine as claimed in claim 10, wherein the case includes a drain rib on a lower side of the cable receiver sloped down toward the inserting hole to drain water introduced to the inside of the case through the cable.

12. The laundry machine as claimed in claim 1, wherein the case includes a slot provided along the longitudinal direction of the cable.

* * * * *